US010893784B2

(12) United States Patent
Majer

(10) Patent No.: US 10,893,784 B2
(45) Date of Patent: Jan. 19, 2021

(54) SUCTION HOSE CONNECTING PIECE

(71) Applicant: Festool GmbH, Wendlingen (DE)

(72) Inventor: Michael Majer, Notzingen (DE)

(73) Assignee: FESTOOL GMBH, Wendlingen (DE)

( * ) Notice: Subject to any disclaimer, the term of this patent is extended or adjusted under 35 U.S.C. 154(b) by 372 days.

(21) Appl. No.: 15/536,365

(22) PCT Filed: Dec. 17, 2015

(86) PCT No.: PCT/EP2015/080163
§ 371 (c)(1),
(2) Date: Jun. 15, 2017

(87) PCT Pub. No.: WO2016/097106
PCT Pub. Date: Jun. 23, 2016

(65) Prior Publication Data

US 2017/0347849 A1 Dec. 7, 2017

(30) Foreign Application Priority Data

Dec. 19, 2014 (DE) ..... 10 2014 119 249

(51) Int. Cl.

| | |
|---|---|
| ***F16L 37/107*** | (2006.01) |
| ***A47L 7/00*** | (2006.01) |
| ***A47L 9/24*** | (2006.01) |
| *A47L 5/14* | (2006.01) |
| *A47L 9/00* | (2006.01) |

(52) U.S. Cl.
CPC ..... *A47L 7/0095* (2013.01); *A47L 9/242* (2013.01); *A47L 9/248* (2013.01); *A47L 5/14* (2013.01); *A47L 9/0036* (2013.01)

(58) Field of Classification Search
CPC ..... F16L 37/107; F16L 37/248; A47L 9/244
USPC ..... 285/7, 328, 396, 402
See application file for complete search history.

(56) References Cited

U.S. PATENT DOCUMENTS 1,229,079 A * 6/1917 Hill ..... E21B 17/046 285/396
2,198,905 A 4/1940 Content
(Continued)

FOREIGN PATENT DOCUMENTS

AT 399816 7/1995
CN 1624368 A 6/2005
(Continued)

*Primary Examiner* — Aaron M Dunwoody
(74) *Attorney, Agent, or Firm* — Hoffmann & Baron, LLP

(57) ABSTRACT

A suction hose connecting piece for a suction hose for producing a flow connection from a machine tool to a vacuum cleaner, the connecting piece including a tubular body with a circumferential wall that delimits a flow channel, and a plug section which is arranged on the tubular body for the purpose of producing a plug connection with a mating connecting piece, it being possible to plug the connecting piece and mating connecting piece one onto the other along a longitudinal axis of the plug section, a longitudinal latch contour being arranged on the plug section, counteracting release of the mating connecting piece from the connecting piece relative to the longitudinal axis, and engaging with a longitudinal mating latch contour of the mating connecting piece when the mating connecting piece is plugged onto the connecting piece, along the longitudinal axis of the plug section.

21 Claims, 7 Drawing Sheets

(56) References Cited

U.S. PATENT DOCUMENTS 2,245,847 A * 6/1941 Bagby ..... F16L 37/107 285/83
2,450,527 A * 10/1948 Smith ..... F16L 37/248 285/85
4,625,998 A * 12/1986 Draudt ..... A47L 9/242 285/110
4,688,833 A 8/1987 Todd
5,042,844 A * 8/1991 Iida ..... A47L 9/242 285/251
5,785,357 A * 7/1998 Foster ..... E21B 17/043 285/92
6,206,433 B1 * 3/2001 Bloomer ..... F02M 35/10144 285/82
6,811,190 B1 * 11/2004 Ray ..... F23J 13/04 285/361
7,677,610 B2 * 3/2010 Schwarz ..... F16L 25/0045 285/319
7,857,361 B1 * 12/2010 Hanser ..... F16L 37/138 285/314
8,632,104 B2 * 1/2014 Horikawa ..... F16L 27/12 285/377
8,757,671 B2 * 6/2014 Pallini, Jr. ..... E21B 17/043 285/322
2002/0157716 A1 * 10/2002 Flick ..... F16L 37/32 137/614
2005/0001427 A1 * 1/2005 Liew ..... F16L 37/002 285/322
2005/0040648 A1 2/2005 Smolenski et al.
2007/0057509 A1 * 3/2007 Beal ..... F16L 37/248 285/402
2010/0148499 A1 * 6/2010 Le Quere ..... F16L 37/1215 285/310
2011/0148107 A1 * 6/2011 Blivet ..... F16L 37/252 285/402
2013/0270820 A1 * 10/2013 Py ..... F16L 37/24 285/330
2018/0363390 A1 * 12/2018 Persent ..... F16L 37/113

FOREIGN PATENT DOCUMENTS

CN 1624368 A 6/2005
CN 1781436 A 6/2006
CN 1781436 A 6/2006
CN 201948940 U 8/2011
CN 201948940 U 8/2011
CN 103239190 A 8/2013
CN 103239190 A 8/2013
CN 103363228 A 10/2013
CN 103363228 A 10/2013
DE 102005041802 3/2007
DE 202008006381 9/2008
DE 102012020546 4/2014
FR 746630 11/1932
FR 2807309 10/2001
WO 2016097106 A1 6/2016
WO WO2016097102 6/2016
WO WO2016097103 6/2016
WO WO2016097105 6/2016
WO WO2016097106 6/2016

* cited by examiner

SUCTION HOSE CONNECTING PIECE

This application claims priority based on an International Application filed under the Patent Cooperation Treaty, PCT/EP2015/080163, filed Dec. 17, 2015, which claims priority to DE102014119249.4, filed Dec. 19, 2014.

BACKGROUND OF THE INVENTION

The invention relates to a suction hose connecting piece for a suction hose designed to create a flow connection, in particular from a machine tool to a vacuum cleaner, said connecting piece comprising a tubular body with a circumferential wall which delimits a flow channel and a plug section arranged on said tubular body designed to create a plug connection with a mating connecting piece, wherein the connecting piece and the mating connecting piece can be plugged together along a longitudinal axis of the plug section, wherein a longitudinal latch contour is arranged on the plug section which counteracts detachment of the mating connecting piece from said connecting piece relative to the longitudinal axis and which engages with a mating longitudinal latch contour of the mating connecting piece when the mating connecting piece is plugged onto the connecting piece along the longitudinal axis of the plug section.

The longitudinal snap-locking engagement makes it possible for the connecting piece to hold securely to the mating connecting piece relative to the plugging axis. However, if a high load is applied in the pulling direction or in the direction of the plugging axis, the connection may be released. Particularly if the plug section is also elastic, which facilitates connection to a usually relatively hard suction hose connection of a hand-held machine tool, the longitudinal snap-locking engagement may not be sufficiently resistant to loading.

SUMMARY OF THE INVENTION

It is therefore the object of the present invention to provide an improved suction hose connecting piece for a suction hose.

In order to achieve this object, according to the invention at least one rotational form-fit contour is arranged on the plug section in order to create a form-fit connection with a rotational form-fit mating contour of the mating connecting piece, wherein at least one rotational form-fit contour can be brought into or out of engagement with the rotational form-fit mating contour through a relative rotational movement of the connecting piece and the mating connecting piece.

The plug section can consist, homogenously, of a soft or a hard material, in particular of plastic. Particularly preferable is a reinforcement of the plug section with at least one stiffening element, as will be explained later. The plug section comprises at least one section of the flow channel.

It is thereby a fundamental concept that the rotational form-fit contour creates an optimally secure connection with the rotational form-fit mating contour relative to the longitudinal axis. In any case, a more secure hold is provided relative to a plugging axis or the longitudinal axis than is provided through the longitudinal snap-locking engagement alone.

Advantageously, the material of the plug section is elastic or elastically yielding, as a result of which on the one hand the longitudinal snap-locking engagement is, advantageously, easier to establish or release. If at least one rotational form-fit contour is also provided on the elastic or yielding, in any case relatively soft section of the plug section, this too can make possible a snap-locking engagement which is easily formed while providing a secure hold. For example, a frictional connection between the material of the plug section, which is relatively soft, and the mating connecting piece ensures an optimally secure connection with the mating connecting piece However, the mating connecting piece can also have only one rotational form-fit mating contour or only one mating longitudinal latch contour. The connecting piece is compatible with both types of mating connecting pieces, since it has a longitudinal latch contour and at least one rotational form-fit contour. The connecting piece according to the invention can thus interact with, so to speak, old mating connecting pieces as mentioned above, but also with new mating connecting pieces which possess the rotational form-fit mating contours.

One or more longitudinal latch contours can be provided. The longitudinal latch contour can for example comprise a hook recess, a snap-locking recess or similar. A longitudinal latch contour can for example be partially annular in form. It is particularly preferable if a longitudinal latch contour is annular in form. For example, the longitudinal latch contour can comprise a peripheral groove or an in particular peripheral, annular projection.

The longitudinal latch contour can also comprise a ribbed structure.

The at least one longitudinal latch contour can be arranged on an inner periphery or an outer periphery of the plug section. It is also possible that at least one longitudinal latch contour is provided both on the outer periphery and also on the inner periphery.

It is advantageous if the at least one longitudinal latch contour and the at least one rotational form-fit contour are both arranged on the inner periphery or on the outer periphery.

It is also possible for at least one longitudinal latch contour to be arranged on the inner periphery of the plug section and for the at least one rotational form-fit contour to be arranged on the outer periphery or, conversely, for the rotational form-fit contour to be arranged on the inner periphery and the longitudinal latch contour on the outer periphery.

The at least one rotational form-fit contour and the at least one longitudinal latch contour are preferably arranged behind one another relative to a plugging axis or a plugging direction. The arrangement can be such that for example the longitudinal latch contour is arranged closer to the plug-in opening or the plug-on contour of the plug section, so that, when being plugged onto the connecting piece, a mating connecting piece first comes into contact with the longitudinal latch contour and then with the at least one rotational form-fit contour, for example if a rotational form-fit mating contour interacting with the rotational form-fit contour is provided on the mating connecting piece.

Expediently, rotational form-fit contours are provided on the plug section in order to create a form-fit connection between the connecting piece and the relevant mating connecting piece which can be brought into engagement or out of engagement with rotational form-fit mating contours of the respective mating connecting piece through a relative rotational movement of the connecting piece and of the mating connecting piece around a longitudinal axis of the plug section.

Advantageously, the rotational form-fit contours can comprise at least one inner rotational form-fit contour, arranged on an inner periphery of the plug section, for a mating outer rotational form-fit contour arranged on an outer periphery of the plug-in mating connecting piece and at least one outer rotational form-fit contour, arranged on an outer periphery of the plug section, for a mating inner rotational form-fit contour arranged on an inner periphery of the plug-on mating connecting piece. Thus, rotational form-fit contours are provided on both the inside and the outside of the plug section.

It is thereby a basic concept that the connecting piece is designed such that a mating connecting piece can either be plugged into it or plugged onto it, selectively, and in both cases can establish a rotational form-fit connection. The rotational form-fit connection has the advantage, in comparison with a form-fit acting exclusively in the plugging direction, that a more secure hold can be guaranteed in the direction of pull or in the direction of the longitudinal axis of the plug section, which for example forms a plugging axis.

The rotational form-fit contour can comprise rotational form-fit projections and rotational form-fit recesses or can be provided on rotational form-fit projections or on rotational form-fit recesses.

For example, the mating connecting piece can be screwed together with the connecting piece according to the invention. The screwed connection is possible in both cases, namely on the one hand in the sense of a screwing-on, that is to say if the mating connecting piece is screwed onto the connecting piece, but also in the sense of a screwing-in, that is to say that the mating connecting piece is screwed into the connecting piece. Particularly preferably, a plugging-rotational movement is required, i.e. the connecting piece and the mating connecting piece are, so to speak, plugged together and then fixed together with one another in a form-fit manner by means of a rotational movement. This will become clearer later.

The rotational form-fit contours, that is to say both the inner and also the outer rotational form-fit contours, can for example comprise one or more peripheral rotational form-fit contours running helically relative to the plugging axis. However, a peripheral rotational form-fit contour running at right angles, for example in the form of a peripheral groove, is also advantageous. It is also advantageous if the peripheral rotational form-fit contour comprises a thread and/or at least one bayonet-type rotational form-fit contour or both.

In any case this makes it clear that many variants of rotational form-fit contours are possible, namely threads, helices, peripheral grooves which run roughly at right angles or which are inclined at an obtuse angle relative to the plugging axis, hook-formed structures or the like. Naturally, a rotational form-fit contour of the connecting piece can also for example comprise a cam or a rotational form-fit projection.

Advantageously, a form-fit contour, in particular a rotational form-fit contour is provided which has at least one positioning bevel or wedging bevel which, on a relative rotation of the connecting piece and the mating connecting piece, causes a displacement and/or clamping of the connecting piece and the mating connecting piece towards one another along the longitudinal axis. Advantageously, two positioning bevels, interacting with one another, are provided on the connecting piece and mating connecting piece, although one positioning bevel or wedging bevel is sufficient.

It is also possible that rotational form-fit contours which differ in geometrical form and/or size are provided, so to speak on the inside and outside of the connecting piece. Also, inner rotational form-fit projections and outer rotational form-fit recesses can for example be provided. It is for example possible that for example a peripheral groove, a thread or a bayonet-fitting arrangement is provided radially on the outside whereas, to accommodate a mating connecting piece which is designed to be plugged in, a cam or other rotational form-fit contour is provided on the inside. The inner rotational form-fit contour can thus, for example, be one which does not comprise a groove running in a peripheral direction.

Advantageously, in the interest of compatibility, groove-like or grooved rotational form-fit contours, in any case at least one groove-like rotational form-fit contour is for example provided on the outer periphery or radially on the outside of the connecting piece, while individual projections, cams or similar are provided on the inner periphery, or so to speak radially on the inside.

For example, according to an advantageous embodiment of the invention, the at least one inner rotational form-fit contour of the connecting piece according to the invention and the associated mating inner rotational form-fit contour of the mating connecting piece possess identical contours. It is also in the interest of compatibility if the at least one outer rotational form-fit contour and the mating outer rotational form-fit contour (of the mating connecting piece) possess identical contours. The identical form of the contours is preferably such that the geometry and/or size of the rotational form-fit contours are identical or at least match one another.

In at least one, advantageously several peripheral rotational form-fit contours it is advantageous if the respective peripheral rotational form-fit contour communicates with a longitudinal guide contour running substantially parallel to the plugging axis, so that a rotational form-fit mating contour, for example a form-fit projection, cam or the like, can be introduced along the longitudinal guide contour into the peripheral rotational form-fit contour and can if necessary also be moved out again. For example, the longitudinal guide contour is a guide channel or the like. For example, the longitudinal guide contour and the peripheral rotational form-fit contour form an L-formed or hook-like arrangement. As already mentioned, the rotational form-fit mating contour can, so to speak, be moved along the longitudinal guide contour and then rotated, so that it engages in a form-fit manner in the at least one peripheral rotational form-fit contour.

However, the longitudinal guide contour can be relatively broad or wide, i.e. it allows the rotational form-fit mating contour not only to be plugged or moved in a linear direction along the longitudinal guide contour but also rotated to a certain extent. This means that, within the longitudinal guide contour, the rotational form-fit contour can have some play transversely to the plugging axis or transversely to the longitudinal axis of the plug section, for example rotary play.

According to an advantageous variant, the longitudinal guide contour narrows, i.e. is narrower, in the direction of the peripheral rotational form-fit contour, so that the rotational form-fit mating contour is so to speak guided by the longitudinal guide contour in the direction of the peripheral rotational form-fit contour. The longitudinal guide contour can be wider in the region of its plug-in opening and narrower in the region of the peripheral rotational form-fit contour. For example, the longitudinal guide contour can extend in the form of a funnel or conically.

The rotational form-fit contour can also comprise at least one form-fit projection, for example a cam, a bayonet-hook or the like, which can be screwed into a rotational form-fit mating contour running in a peripheral direction around the longitudinal axis of the plug section. The rotational form-fit mating contours can, for example, like the rotational form-fit contours of the connecting piece according to the invention, comprise peripheral grooves running in a peripheral direction, peripheral rotary mating form-fit contours running in a helix or the like.

The at least one form-fit projection preferably forms a component of the inner rotational form-fit contour and projects radially inwards from a circumferential wall of the plug section in the direction of the flow channel.

Preferably, at least one latch contour is provided which can be brought into snap-locking engagement or out of snap-locking engagement with a mating latch contour of the mating connecting piece through the relative rotational movement of the connecting piece and the mating connecting piece around the longitudinal axis of the plug section and/or a sliding movement or longitudinal movement, for example parallel or substantially parallel to the longitudinal axis of the plug section or also obliquely to this longitudinal axis. Thus, in this case not only a rotational form-fit connection but also a snap-locking engagement is achieved. The rotational form-fit connection is thus additionally secured by means of a snap-locking engagement. In particular, this involves a rotary snap-locking engagement, rotary locking or similar. For example, the latch contour comprises a snap-locking nose, a snap-locking depression or the like. However, a longitudinal snap-locking engagement which is brought into engagement or out of engagement by means of a sliding movement of the connecting piece and mating connecting piece relative to one another forms an additional securing measure.

The latch contour can for example be spring-loaded by means of a spring or a spring element, for example a helical spring. It is preferable if, in order to achieve a spring effect, the at least one latch contour consists of an elastic material and/or is arranged on an elastic section of the connecting piece. Naturally, it would also be possible for the latch contour to be fixed in place or hard, while the mating latch contour communicating or interacting with the latch contour of the connecting piece is itself spring-loaded. Thus, it need not be the case that the latch contour of the connecting piece as such is resilient or resiliently yielding or elastic; instead, the mating connecting piece, possibly not even designed according to the invention, can possess the spring-loaded property, for example an elastic mating latch contour. The mating latch contour can for example also be a snap-locking hook or snap-locking cam.

According to a further embodiment of the invention, the rotational form-fit connection is secured by means of a locking mechanism, for example by means of a locking bar element mounted displaceably on the connecting piece or mating connecting piece or the like. The locking bar element can engage in the latch contour of the connecting piece in order to establish the locking effect.

Expediently, the at least one latch contour comprises a snap-locking recess running transversely to the relative rotational movement or a snap-locking projection running transversely to the relative rotational movement, for example a rib.

Preferably, the latch contour of the connecting piece extends roughly parallel to the longitudinal axis or to the plugging axis of the plug section.

The latch contour and the mating latch contour can establish a snap-locking engagement, i.e. a longitudinal snap-locking engagement or rotary snap-locking engagement, in particular when the connecting piece and the mating connecting piece have reached their rotary end position. However, it is also possible that the snap-locking engagement, in particular the rotary snap-locking engagement only so to speak represents an additional safeguard, while still permitting a relative rotational movement of the connecting piece and mating connecting piece. In this case, the connecting piece and the mating connecting piece still have some rotary play around the longitudinal axis of the plug section or plugging axis of the plug section, even though they are snap-locked together with one another.

According to a particularly preferable embodiment the invention, the at least [sic] latch contour, for example the rib or the recess, is arranged between the aforementioned longitudinal guide contour and the peripheral rotational form-fit contour. For example, the at least one latch contour extends, for example in its axial extension, parallel to the plugging axis or to the longitudinal axis of the plug section, to a side wall of the longitudinal guide contour. It is possible that the at least one latch contour so to speak forms a rib or a groove between the longitudinal guide contour and the peripheral rotational form-fit contour.

According to one embodiment of the invention, the plug section and the tubular body carrying the plug section can consist of an identical or similar material. It is for example possible that the plug section and the tubular body carrying this plug section consist of the same plastic and/or exhibit the same hardness and/or elasticity.

According to a preferred exemplary embodiment, the plug section is relatively soft, in any case consisting of a softer material than the tubular body carrying the plug section. The plug section can also be made of a softer material than the tubular body supporting it, i.e. it need not consist, as a whole, of the softer material. It is also possible that the plug section as a whole consists of the softer material or is designed in the form of a multiple-component part, i.e. that for example it contains sections or components made of a harder material and sections or components made of a softer material. The harder material is preferably the same as that used in the tubular body.

It is preferable if a certain elasticity is present which improves the form-fit. For example, the rotational form-fit contours and/or the latch contour can be elastically yielding.

For example, it is advantageous if at least one of the rotational form-fit contours and/or a latch contour are elastically yielding or are arranged on the elastically yielding material.

According to an advantageous variant of the invention, a rotational form-fit contour, a latch contour or the like is relatively hard and the adjacent material is relatively soft. For example, in such a variant the at least one rotational form-fit contour or latch contour consists of a harder or less elastic material than the main plug section body of the plug section carrying the rotational form-fit contour or latch contour. In this way, the rotational form-fit connection or the snap-locking engagement can be ensured due to the relatively hard and thus wear-resistant material of the rotational form-fit contour or the latch contour. The connection is precise and dimensionally accurate. On the other hand, the main plug section body is slightly yielding, so that the contours of the connecting piece and mating connecting piece which interact in a form-fit manner, namely the rotational form-fit contours and the rotational form-fit mating contours and/or the latch contour as well as the associated mating latch contour can lie in optimal contact with one another.

It is also advantageous if a form-fit contour, for example a rotational form-fit contour, plugging form-fit contour or latch contour, consists of a relatively low-friction and/or hard material, so that the relevant form-fit contour can slide easily along the mating form-fit contour. It is thereby possible that defined sliding surfaces are provided, i.e. sections which can easily slide against one another. In this case, next to the sliding surface is, expediently, a form-fit surface which, however, exhibits a higher friction, for example because an elastic or softer material is provided there.

According to an advantageous variant of the invention, at least one form-fit contour, for example the at least one rotational form-fit contour or the latch contour or both, are provided on a form-fit body, for example a cam or other form-fit projection, a recess, for example a groove, or the like. Expediently, a recess, for example a groove, notch or the like, is provided on the relevant form-fit body which is suitable for deformation of the form-fit body. If the form-fit body is brought into or out of engagement with the associated mating contour, the recess makes possible a deformation or yielding of the form-fit body, so that for example the rotational form-fit contour or latch contour can move away from the associated mating contour, namely the respective rotational form-fit mating contour or mating latch contour. The recess can be completely free, so to speak filled with air, which allows a particularly great freedom of movement. However, it is also possible that the form-fit body consists of a relatively hard material and the recess is so to speak filled, or filled out, with softer material, for example of the main plug section body carrying the form-fit body.

Advantageously, the plug section consists of a more elastically yielding material than the tubular body. At least one rotational form-fit contour is arranged on the soft plug section. It is thereby a basic concept that an improved hold of the mating connecting piece is guaranteed through the rotational form-fit contours being arranged on the relatively soft plug section.

It is thereby a basic concept that an improved hold of the mating connecting piece is guaranteed through the rotational form-fit contours or at least one rotational form-fit contour being arranged on the relatively soft plug section.

For example, the plug section yields elastically, so that it can for example be plugged onto the mating connecting piece. The plug section plugged onto the mating connector so to speak clamps the mating connecting piece, preventing it from twisting, or impeding this. In this way, the rotational form-fit contours and rotational form-fit mating contours remain in optimal engagement, so that the connecting piece and the mating connecting piece hold together firmly. This principle functions equally well if the plug section is plugged into a plugging recess of the mating connecting piece and is in consequence compressed somewhat. The plug section tends to widen out, so that it is relatively difficult for it to be twisted in the plugging recess. As a result, the rotational form-fit contours and rotational form-fit mating contours remain in optimal engagement.

A further aspect is that, as a rule, a relatively soft material, of which the plug section consists or which the plug section comprises, exhibits a higher friction than a hard material. The friction also counteracts an unintentional release of the rotational form-fit engagement.

The rotational form-fit contours can comprise rotational form-fit projections and rotational form-fit recesses or can be provided on rotational form-fit projections or rotational form-fit recesses.

In the connecting piece according to the invention, rotational form-fit contours can be provided on the inner periphery of the plug section or on the outer periphery of the plug section. Preferred is a variant in which rotational form-fit contours are arranged both on the inside and on the outside. It is thus advantageous if the at least one rotational form-fit contour comprises at least one inner rotational form-fit contour arranged on an inner periphery of the plug section to accommodate a mating outer rotational form-fit contour arranged on an outer periphery of the mating plug-in connecting piece and at least one outer rotational form-fit contour arranged on an outer periphery of the plug section to accommodate a mating inner rotational form-fit contour arranged on an inner periphery of the plug-on mating connecting piece.

Advantageously, the connecting piece has a tubular section, structured as a multiple-component section, with a longitudinal axis, wherein, as a second component, at least one elongated stiffening element made of a stiffening material which is harder and/or which exhibits higher tensile strength and/or flexural strength and/or greater stiffness in comparison with the basic material is embedded in a basic material of the tubular section forming a first component. The tubular section can for example form the plug section or another section of the connecting piece. Form-fit elements, designed for example to create a longitudinal or a rotational form-fit engagement, can be provided on the tubular section.

It is thereby a basic concept that the basic material is so to speak fundamentally somewhat more yielding than the stiffening material, so that for example a compression or widening is possible when plugging into or onto the mating connecting piece. At the same time the stiffening material, comprising elongated, for example strip-formed stiffening elements, ensures that the tubular section is less susceptible to bending relative to its longitudinal direction. The tubular section is thus for example more resistant to bending than another section of the suction hose connecting piece, so that it exhibits less of a tendency to buckle. This facilitates for example the plugging-together of the connecting piece and mating connecting piece.

It should be understood that even a single stiffening element has the effect desired according to the invention, that is to say it reduces the tendency of the tubular section to buckle. However, it is preferable if several stiffening elements are provided. The following explanations therefore relate to a connecting piece in which, as a rule, several stiffening elements are provided. Insofar as these relate to the geometrical configurations of a particular stiffening element, these are naturally also readily possible in the case of a single stiffening element.

Expediently, the at least one stiffening element extends parallel to a longitudinal axis of the at least one tubular section. However, it can also be inclined at an angle to the longitudinal axis, in particular an angle of less than 90°, in particular of less than 45°. Particularly preferable is a relatively shallow inclination of the stiffening elements relative to the longitudinal axis of the tubular section, for example of around 5-20°. This allows the stiffening elements to stiffen the tubular section optimally transversely to the longitudinal axis.

For example, the at least one stiffening element extends in the direction of a plugging axis along which the connecting piece can be plugged onto the mating connecting piece. The at least one stiffening element thereby counteracts a buckling of the tubular section.

It is also possible that at least one stiffening element and/or at least a part of the stiffening elements extends in the peripheral direction of the tubular section. For example, the at least one stiffening element has, or the stiffening elements have, an annular or circular or arc-formed path and/or are arranged in a circle or arc. For example, the stiffening acts in such a way that the tubular section can be less readily compressed.

It is also possible that the stiffening elements are embedded so to speak chaotically or irregularly in the basic material of the connecting piece. For example, it is possible that the stiffening elements comprise or are formed by fibres.

Expediently, it can also be the case that the at least one stiffening element is not designed in the form of a mesh. It is thus expedient if the stiffening elements have an oriented structure, that is to say that, for example in the case of a fibrous structure, the stiffening elements are oriented substantially parallel to one another, in particular in the direction of the longitudinal axis.

Advantageously, the at least one stiffening element can have a larger cross section than a glass fibre or textile fibre. The at least one stiffening element can be relatively massive, i.e. not in the form of a thin fibre. Nonetheless, the stiffening element can for example be designed in the form of a lamella or comprise lamellae.

Advantageously, the at least one stiffening element is not, as a whole, designed in the form of a sleeve. This measure can contribute to the stiffening element being able to yield transversely to the longitudinal axis.

It is advantageous if the at least one stiffening element does not consist of a metal. It is advantageous if the at least one stiffening element consists of plastic or a plastic material.

In the following, a number of measures are suggested which facilitate the deformability of the tubular section transversely to the longitudinal axis.

The stiffening elements are expediently arranged at a lateral distance transversely to the longitudinal axis or in a peripheral direction around the longitudinal axis. This means that the basic material of the tubular section can deform elastically transversely to the longitudinal axis, whereby the stiffening elements offer no or little resistance thereto.

The stiffening elements are expediently spaced at a lateral distance from one another in a peripheral direction, i.e. around the longitudinal axis.

The gaps between the stiffening elements contribute to or make it possible for the circumference of the tubular section to be readily widened or compressed, which facilitates plugging onto or into the mating connecting piece or in some cases even makes this possible in the first place.

The at least one stiffening element or several stiffening elements are preferably strip-formed. A stiffening element thus forms for example a stiffening strip. The stiffening elements are preferably lamellar. The stiffening elements can for example be designed in the form of stiffening lamellae. It is preferable if a stiffening element is blade-like.

It is expedient if the at least one stiffening element has a curvature and/or an angled contour transversely to its longitudinal direction or transversely to its direction of longitudinal extension. The curvature or longitudinal contour can be provided only on at least one longitudinal section, i.e. not over the entire length, of the stiffening element. This provides the stiffening element with greater mechanical strength and/or makes it stiffer. For example, the stiffening element is annular or circular in cross section. For example, the at least one stiffening element has an arc-formed cross section or an arc-formed contour on its inner radius and/or on its outer radius. However, the stiffening element can, in cross section, also have two or more arms arranged at an angle to one another. The at least one stiffening element can, in cross section, have at least one angle or can also be polygonal. The at least one stiffening element expediently has a non-flat contour transversely to its longitudinal direction and/or in cross section.

According to a preferred embodiment of the invention, several stiffening elements are arranged next to one another in the manner of segments of a circle. Between each of the stiffening elements is an arc-formed distance or angular distance.

It should be understood that a combination of stiffening fibres and lamella-like or strip-like stiffening elements is readily possible.

It is preferable if the stiffening elements extend along the entire circumference of the tubular section, i.e. the tubular section as a whole, so to speak, has stiffening elements on its circumference.

The stiffening elements can form a kind of cage structure around the longitudinal axis of the tubular section.

The stiffening elements have for example a transverse width which varies relative to their longitudinal direction. For example, they can be somewhat narrower in the region of their free longitudinal ends than in another longitudinal end region or in the region between their longitudinal ends, for example in the region of their longitudinal centre.

The tubular section with the stiffening elements can for example form the plug section of the connecting piece. The plug section stiffened by means of the stiffening elements can be plugged onto the mating connecting piece in a particularly convenient manner. The plug connection is stable and strong. The plug section has a significantly greater resistance to buckling in comparison with a plug section without any stiffening elements.

The stiffening elements, or in any case some of them, for example two or more, are expediently connected with one another in a peripheral direction of the tubular section through a connecting section. The connecting section can for example be formed by a connecting body which resembles segments of a circle or is annular. It is particularly preferable if the tubular body forms such a connecting section. For example, it is possible that at least one stiffening element projects from the tubular body in the tubular section which is reinforced through the stiffening structure or the stiffening elements. For example, the stiffening elements project like fingers from the tubular body or other connecting section and are embedded in the basic material of the tubular section which they reinforce. It can also be the case that the tubular body is provided as a connecting section and an additional connecting section, separate from the tubular body, is provided for the connection of stiffening elements.

It is preferable if the at least one stiffening element is integral or formed in a single piece with the tubular body.

It is preferable if the material of the tubular body forms the material of the at least one stiffening element, i.e. the stiffening material. This variant of the invention is for example readily possible if the at least one stiffening element, preferably several stiffening elements, project from the tubular body in the direction of the tubular section which is reinforced through the stiffening structure. However, it is also possible that, in a spraying process or casting process, a particular material, for example plastic, is used to manufacture at least one stiffening element and a tubular body separate from this which, in a second manufacturing step, are connected with one another through the basic material of the tubular section.

It is preferable if the stiffening material and/or the at least one stiffening element are partially or completely encased in or covered by the basic material of the tubular section. In this way, for example, a basic material which is relatively soft and/or has a high coefficient of friction and/or is elastic can partially or completely enclose the stiffening material or the at least one stiffening element. It is preferable if the stiffening element is covered or encased radially on the outside and/or radially on the inside with the basic material, particularly in the contact region which makes contact with the mating connecting piece.

Expediently, an inner component and an outer component of the basic material of the tubular section are, in separate working operations, formed, for example sprayed or poured, onto the at least one stiffening element or the stiffening material of the tubular section. Quite incidentally, it should be noted that in a preferred embodiment of the invention the basic material is homogeneous, i.e. it is a single material. However, it is also possible to use different materials as the basic material, for example plastics of differing elasticity. For example, in the aforementioned embodiment with inner component and outer component it is readily possible to use a different basic material for the inner component, for example, than for the outer component.

The basic material of the advantageously stiffened tubular section can thus comprise a first and a second basic material.

The plug section and/or the tubular section expediently comprise at least a section of the flow channel.

Form-fit contours, for example form-fit recesses or form-fit projections, can be provided on the advantageously stiffened tubular section. These can be formed of softer and/or harder material, for example of the basic material and/or of the stiffening material. The form-fit contours can for example be rotational form-fit contours, longitudinal latch contours or the like. The rotational form-fit contours can comprise rotational form-fit projections and rotational form-fit recesses or can be provided on rotational form-fit projections or rotational form-fit recesses.

A form-fit contour can also be provided on a stiffening element. The form-fit contour is for example suitable as a rotational form-fit contour, latch contour, in particular longitudinal latch contour or the like, in order to provide a form-fit hold of the mating connecting piece. The form-fit contour thus interacts with a mating form-fit contour of the mating connecting piece when the connecting piece is connected with the mating connecting piece.

For example, the form-fit contour projects, completely or in sections, from the basic material. For example, a type of cam or lug or other form-fit projection can be provided on the stiffening element which projects radially outwards or radially inwards on the inside from the basic material of the tubular section. Naturally, a form-fit recess on the at least one stiffening element is also possible. It is also possible that the form-fit contour is at least in sections encased by the basic material. The basic material is relatively soft, can thus for example exhibit a higher friction than the stiffening material, which leads to the form-fit engagement of the form-fit contour with the mating form-fit contour being better guaranteed through correspondingly higher friction.

According to an advantageous measure, at least one section of the at least one stiffening-element, for example the aforementioned form-fit contour or also another surface, projects from the basic material, so that a sliding surface or electrically conductive surface is formed.

The connecting piece according to the invention is preferably made of plastic. However, metallic components are also possible. In particular, metal is suitable for better conductivity, for example in order to dissipate electrostatic charge.

A preferably relatively hard material from which, for example, a so-called hard component, in particular the tubular body and/or at least one of the stiffening elements wholly or substantially consists is expediently polypropylene or a polyamide. The harder material can also comprise a thermoplastic elastomer (TPE). Although these materials can also be used for the softer material, in this case they have lower strength or hardness. The property of hardness can be adjusted, so to speak, depending on the cross-linking of the thermoplastic elastomer and/or composition of the components of the elastomer. The thermoplastic elastomer is for example a so-called copolymer and consists of a "soft" elastomer and a "hard" thermoplastic component, the proportions of which are selected according to the desired Shore hardness.

For example, the harder or stiffer material is 1.5 times or twice or three times as stiff as the softer material. However, the stiffer material can also be four or five times as stiff as the softer material. This is also the case if both materials fundamentally have the same chemical basis, for example TPE plastics of similar composition are, for example TPEU or TPU (urethane-based thermoplastic elastomers) or TPES or TPS=styrene block copolymers (SBS, SEBS, SEPS, SEEPS and MBS).

The softer or more elastic material from which for example the main plug section body, in particular its inner component and/or outer component, consists, in particular its inner component and/or outer component, is preferably an elastomer, in particular a thermoplastic elastomer. The elastomer is for example a vulcanisate of natural rubber and silicone rubber.

It should be understood that the softer material can also comprise or be formed of rubber, elastic or the like.

The main plug section body of the plug section, in particular its inner component, preferably consists of a softer or more elastic material than the tubular body. The relatively soft, elastic plug section ensures a firm fit and a high density of the plug section of the mating connecting piece. In addition, the plug section has a certain tolerance, i.e. it to some extent conforms itself, so to speak, to the geometry of the associated mating plug section of the mating connecting piece due to its elasticity or softness.

The explained different materials can advantageously be provided for different purposes, for example harder materials for form-fit contours and softer materials in order to provide their resilience. The softer or more elastic basic material can also serve to make a section of the connecting piece yielding, for example for the purpose of allowing compression when plugging into a plugging recess of the mating connecting piece, or provide a possibility for widening when being plugged onto a plug section of the mating connecting piece. Materials which are harder and/or more resistant to tensile forces and/or bending which follow on from this softer section in the direction of a longitudinal axis or which are preferably embedded in the softer section serve for example to stiffen this softer section or also for example to connect the suction hose. A relatively hard tubular body is for example suitable for accommodating a mounting for the suction hose such that it is rotatable yet resistant to tensile forces.

It is also advantageous if relatively hard materials are also so to speak embedded in a softer material or are at least partially covered by or encased in softer material. The softer material exhibits for example higher friction than a harder material, as a result of which a frictional connection or the hold between the connecting piece and mating connecting piece is improved. It is for example possible that for example a form-fit body which forms a latch contour, a form-fit contour, in particular a rotational form-fit contour or the like, is manufactured with a coating of a softer material.

It is also consistent with the invention if a form-fit body is formed in a single piece or is homogeneous with the main body on which it is arranged, for example the main plug section body or the like.

Also, materials exhibiting different degrees of hardness and/or tensile strength and/or elasticity can be used to manufacture the connecting piece as a whole or sections thereof as a multiple-component part or to form a connecting piece with a multiple-component section.

The different materials of the connecting piece are for example characterised by the following properties. A harder component or a harder material has for example a hardness of 20/100 Shore D or 30/100 Shore D. However, the harder component can also be somewhat softer overall, for example 20/70 Shore D, 30/70 Shore D or 30/60 Shore D. In the case of the soft component or the softer material, it is advantageous if it has a hardness of 40/100 Shore A, particularly preferably 50/90 Shore A. However, hardnesses of 60/80 Shore A are also readily possible.

With regard to elasticity, one for example harder component or one for example harder material has a modulus of elasticity of for example 80-2500 $N/mm^2$, in particular 1000 to 1800 $N/mm^2$. In contrast, the softer or more elastic material has a modulus of elasticity of at most 800 $N/mm^2$, expediently at most 700 $N/mm^2$, particularly preferably at most 600 $N/mm^2$.

With regard to elongation at tear or elongation at break it is advantageous if the softer component or the softer material has an elongation at tear or elongation at break of at least 70%, particularly preferably of at least 80% or even of at least 100%. In the case of the harder or less tear-resistant material, an elongation at tear or elongation at break of greater than 5% or 10%, expediently greater than 30%, but also greater than 40% or 50% is advantageous.

A stiffness of the harder or stiffer material is expediently 1.5 times or twice or three times as high as the stiffness of the softer or less stiff material. Even if the basic material and the stiffening material are chemically similar or so to speak have the same chemical basis (for example TPE, in particular TPES or TPEU/TPU), the explained stiffening elements preferably exhibit such a higher stiffness than the basic material of the tubular section or plug section.

Also, advantageously, electrically conductive materials are provided, in particular materials with different electrically conductive properties. Electrically conductive materials can for example be used to dissipate electrostatic charges. For example, a softer and/or a harder material of the connecting piece according to the invention can be electrically conductive. It is also possible that the connecting piece as a whole or parts thereof are not electrically conductive.

In the case of materials with different electrically conductive properties, for example the more elastic or softer material can be less electrically conductive than the harder material or vice versa. In any case, it is advantageous if the second, electrically conductive material projects before the first, electrically less conductive material, for example the elastic material, at least at those points where an electrical contact or an electrical connection with the mating connecting piece is necessary or advantageous. It is thus an advantageous variant of the invention if the connecting piece comprises a first material which is less electrically conductive than a second material, wherein the second material projects, at least in sections, before the first material in order to create an electrical connection with the mating connecting piece or is arranged before the first material.

The connecting piece according to the invention can for example include a mounting for a suction hose. The mounting can form an integral part of the tubular body, for example having corresponding ribs designed to accommodate a reinforcing spiral of a suction hose. Preferably, however, the mounting is provided on the tubular body as a separate component, for example being mounted rotatably on the tubular body while being fixed on the tubular body so as to be resistant to tensile forces. It is also possible for the mounting to be fixed in place on the tubular body, that is to say immovably or with a slight amount of play.

The connecting piece according to the invention and the mating connecting piece expediently form a system consisting of connecting piece and mating connecting piece. Naturally, all of the variants of the connecting piece described above and in the following also apply to the mating connecting piece. The mating connecting piece can, like the connecting piece, form a fixed component of a hand-held machine tool or of a vacuum cleaner or of a suction hose.

Variants of the connecting piece explained in the exemplary embodiments are also readily possible in the case of a mating connecting piece. The respective connecting pieces or mating connecting pieces can also form components of machine tools or vacuum devices. A connecting piece according to the invention can also have for example two or more plug sections. For example, two plug sections can be provided on opposite sides of the tubular body. Also, at least two plug sections, suitable for different plugging diameters of the mating connecting piece, can be arranged on the same side. Such plug sections can for example can be nested coaxially inside one another.

The connecting piece expediently includes a mounting for a suction hose. The mounting has for example clamping contours or holding contours or rotational form-fit contours for the suction hose. In particular, screw contours or other contours are provided on the mounting for the purpose of fixing the suction hose in place, in particular in such a manner that it is resistant to tensile force and/or twisting.

Expediently, the mounting is provided on the tubular body. For example, the mounting is arranged so as to be resistant to rotation and/or resistant to sliding and/or fixed in place relative to the tubular body or another component of the connecting piece. The mounting can also form an integral component of the connecting piece, for example forming a single piece with the tubular body. The mounting can be rotatable relative to the plug section. The mounting is expediently resistant to displacement relative to the plug section along the longitudinal axis. It is also possible that, while being resistant to displacement relative to the longitudinal axis, the mounting is mounted on the tubular body or another section of the connecting piece so as to be rotatable.

At least one form-fit body of the connecting piece, which for example forms a rotational form-fit contour, a longitudinal latch contour or the like, has a basic material which, at least in sections in the region of the form-fit contour, is covered with, in particular encased in a material which is softer or more elastic relative to the basic material. It is also advantageous if this other material has a higher friction coefficient than the basic material. In any case, this improves the form-fit union with a mating form-fit contour interacting with the form-fit contour.

The connecting piece according to the invention can also form a component of a hand-held machine tool. In this case, a hand-held machine tool is also understood to refer to a machine tool which is for example portable, for example a mitre saw. Preferable is for example use with hand-held circular saws, milling machines or the like. The rotational form-fit contour guarantees a particularly secure and reliable connection. The connecting piece can be permanently attached to the hand-held machine tool, but can also be designed to be detachable.

The connecting piece can comprise several components arranged in a row behind one another, for example the plug section as well as a single-part or multiple-part tubular body. The multiple-part tubular body can for example be designed such that it comprises two tubular body sections which can be rotated and/or displaced relative to one another. It is also possible for the tubular body to be divisible, for example it can comprise sections which can be screwed, snapped, latched or otherwise connected detachably with one another.

The connecting piece can also be a separate connecting piece, designed for example as an adapter, by means of which for example two hose sections of the suction hose can be connected with one another.

The connecting piece according to the invention can for example be round in cross section. However, it is also possible for the connecting piece to have a polygonal cross section. For example, it is conceivable that the connecting piece still remains rotatable even with a polygonal cross section, for example with at least 8 or 12 corners, that is to say with relatively shallow-angled corner regions, so that it can be rotated relative to the mating connecting piece and the elastic regions so to speak yield during the rotational movement.

A plug section of a connecting piece according to the invention can serve to be plugged into, or onto, by the mating connecting piece along the longitudinal axis of the plug section, so to speak the plugging axis. It is also possible for a rotational movement to be superimposed on this plugging movement, so that in principle the connecting piece and the mating connecting piece move relative to one another along the longitudinal axis of the plug section, but at the same time are rotated relative to one another when the connection between the connecting piece and the mating connecting piece is established. A sequential connection is also possible, that is to say the connecting piece and the mating connecting piece are rotated relative to one another and plugged together or separated from one another along the longitudinal axis or plugging axis in a sequential movement.

BRIEF DESCRIPTION OF THE DRAWINGS

Exemplary embodiments of the invention are explained in the following with reference to the drawing, wherein:

FIG. 3 shows an exploded view of a variant of the connecting piece shown in FIG. 1, of which

DETAILED DESCRIPTION OF THE PREFERRED EMBODIMENTS

A number of exemplary embodiments of the invention are explained in the following, some of which contain identical or equivalent elements or components. In this case, the same reference numbers are used where possible. Furthermore, features of the connecting piece explained in the following are also advantageous in the mating connecting pieces which match this connecting piece. The mating connecting pieces expediently form system components of a system consisting of connecting piece and mating connecting piece. Some mating connecting pieces are also consistent with the invention if, for example, they have rotational form-fit contours arranged radially on the inside and radially on the outside.

Figure 6:
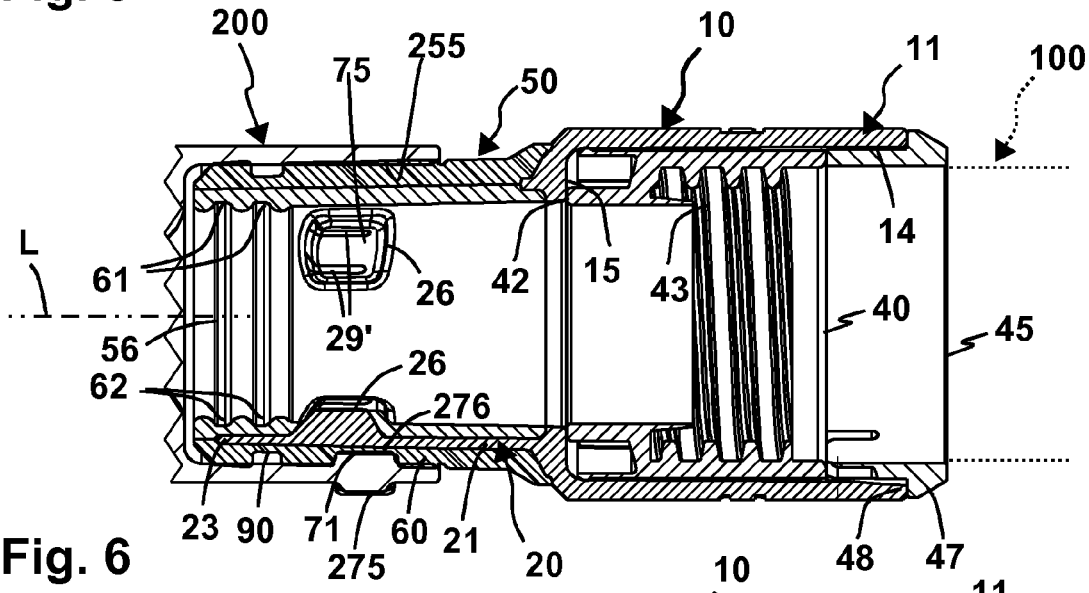
Figure 7:
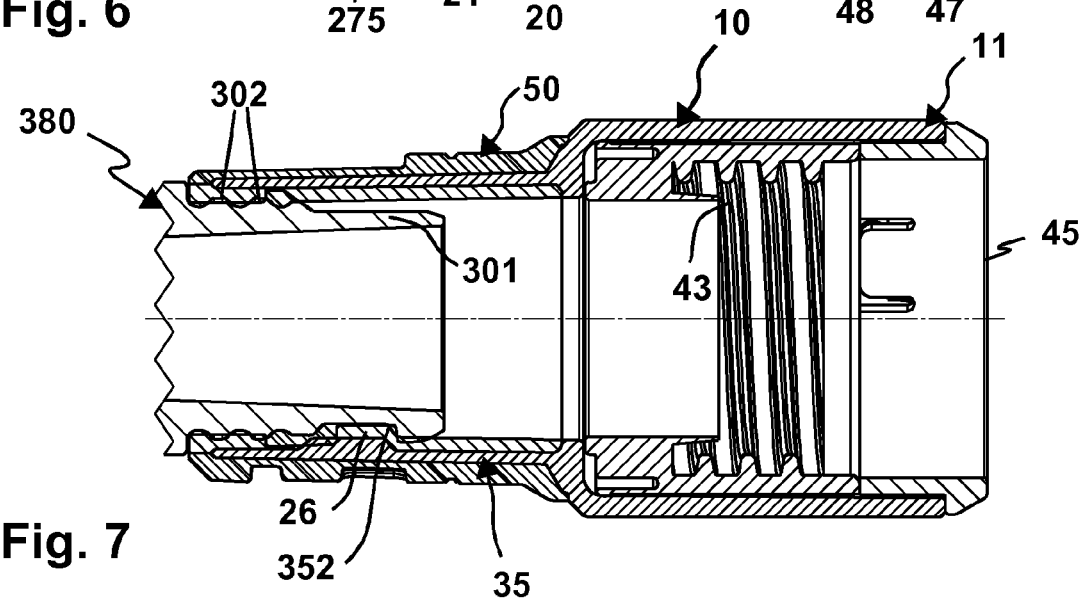
FIG. 7 is plugged.

A connecting piece 10 for a suction hose 100 has for example a tubular body 11. Extending from the tubular body 11 is a plug section 50 designed for the plugging-on of a mating connecting piece 200 as shown in FIG. 6 or for the plugging-in of a mating connecting piece 380 as represented in FIG. 7.

The tubular body 11 comprises a circumferential wall 12 which defines the limits of a recess 19. A mounting 40 for the suction hose 100 is fitted in the recess 19. The mounting 40, which for example comprises a tubular retaining body 41, is preferably accommodated rotatably in the recess 19. A circumferential wall 43*a* of the mounting 40 lies for example rotatably mounted against the inner side 14 of the circumferential wall 12 of the tubular body 11. Inside, the retaining body 41 has a retaining structure 43 for retaining the suction hose 100, for example a ribbed structure or a thread into which in particular helical reinforcing ribs—not shown—of the suction hose 100 can be screwed. A foremost, free end face 42 of the retaining body 41 or the mounting 40 lies against the end face of a base 15 of the tubular body 11.

The mounting 40 is fixed onto the tubular body 12 by a retaining element 45. For example, a supporting flange or a retaining projection 47 is supported on a foremost free end face or narrow side 16 of the tubular body 11. For example, a supporting surface 48 of the retaining projection 47 rests against the free end face 16. A foremost free end face 46 of the retaining element 45 supports an end face 44 of the mounting 40, so that the mounting 40 is sandwiched and/or held in a slide-resistant manner between the retaining element 45 on the one hand and the base 15 of the recess 19 on the other hand.

In order to ensure a secure hold of the retaining element 45 during use, snap-locking projections or retaining projections 49 are provided which project radially outwards from the retaining element 45 or its main body or retaining body and engage in snap-locking recesses or retaining recesses 13 of the tubular body 12. Preferably, the retaining projections 49 are resilient springs or designed in the form of snap-locking tabs, so that they can be forced inwards in the direction of the recess 19 in order to detach the retaining element 45 from the tubular body 12.

It should be understood that in one embodiment—not shown—the tubular body 11 can integrally incorporate the retaining structure 43, that is to say it can accommodate and hold the suction hose 100 directly.

The tubular body 11 and/or the retaining element 45 and/or the mounting 40 are preferably made of a relatively hard plastic material, for example polypropylene. This readily guarantees the strength necessary in order to hold the suction hose 100. However, it is also possible that for example the retaining element 45 and the tubular body 11 are made of a harder material than the mounting 40 for the suction hose 100. In any case, the connecting piece 11 is harder in the region of the tubular body 11 than in the region of the plug section 50, the basic material of which is a plastic with low hardness and in particular with greater flexibility or elasticity. For example, the basic material of the plug section 50 is thermoplastic elastomer.

Nonetheless, the plug section 50 also has a relatively high flexural strength, in any case a higher flexural strength than would be the case if only thermoplastic elastomer were used. A stiffening structure 20 with several stiffening elements 21 is provided for stiffening purposes. The material of the stiffening elements 21 is harder and/or has greater tensile strength and/or flexural strength and/or is stiffer than the basic material of the plug section 50. Preferably, the material of the stiffening elements 21 is at least 1.5 times, preferably 2 to three times or even four times harder or stiffer than that of the section of the connecting piece stiffened by means of the stiffening elements 21, for example of the plug section 50. The plug section 50 forms a tubular section 35. The plug section 50 is designed for a complementary mating plug section to be plugged onto or into it, and is thereby on the one hand elastically yielding in order in this way to make possible an optimal form-fit and an optimal seal with the mating connecting piece; on the other hand it is relatively stiff transversely to the longitudinal axis L or plugging axis. Incidentally, it should be noted that of course the tubular body 11 can also be designed in the manner of the plug section 50 or tubular section 35, even though this is not shown in the drawing, i.e. stiffening elements can for example consist of a relatively soft material.

The basic material of the plug section 50 forms an inner component 52 and an outer component 51 which advantageously completely encases the stiffening elements 21, which are strip-formed. The stiffening elements 21 project from the tubular body 12 forming a 15 connecting section 25 or connecting body for the stiffening elements 21 in the direction of the plug section 50 in the manner of strips or lamellae. A circumferential gap 24 is provided between each of the stiffening elements 21, so that the stiffening elements 21 are spaced apart in a peripheral direction. The stiffening elements 21 can thus approach closer to one another in a peripheral direction or can be spread apart, so that a cross section of the plug 20 section 50 can be reduced in size or enlarged when the plug section 50 is plugged onto a mating connecting piece 300 or plugged into a mating connecting piece 200.

In addition, the moveability or elasticity of the plug section 50 is further improved in that the free end regions 23 of the stiffening elements 21 are narrower than their foot regions or other longitudinal end regions 22 which are connected with the tubular body 12. As already mentioned, the tubular body 12 forms a connecting body for the stiffening elements 21, so that these are connected with one another at one longitudinal end and can be moved towards or away from one another at their free longitudinal end regions 23 in order to enlarge or reduce the cross section of the plug section 50.

The stiffening elements 21 are round in cross section, the radius corresponding approximately to the radius of the tubular body 11. The fact that the contour of the stiffening elements 21 is not flat in cross section but rounded or angled increases the stiffening effect.

The stiffening elements 21 and the tubular body 11 consist for example of polypropylene, in any case one of the relatively hard materials mentioned above. In contrast, the inner component 52 and the outer component 51 are softer and more elastic, being for example made of rubber or of an elastomer, in particular a thermoplastic elastomer.

The inner component 52 and the outer component 51 of the plug section 50 accommodate the stiffening structure 22 integrally, that is to say the stiffening elements 21 are so to speak sandwiched between the inner component 52 and the outer component 51. Expediently, the inner component 52 and the outer component 51 are sprayed in sequence onto the stiffening structure 20 and thus onto the tubular body 11.

For this purpose, two or more spraying operations are for example carried out in which for example the inner component 52 is first sprayed or moulded onto the stiffening elements 21, followed by the outer component 51. According to a preferred production variant, the inner component 52 is sprayed or cast first, followed by the stiffening elements 21, in particular also, in a single pierce, the tubular body 11, and then the outer component 51.

In such a spraying process, webs 53 are for example formed which fill out the spaces or gaps between the stiffening elements 21, i.e. the circumferential gaps 24. Between the webs 53 are wall sections 54 which cover the so to speak radially inner side of the stiffening-elements 21. The wall sections 54 are somewhat thinner in comparison with the webs 53, for example skin-like. However, they preferably cover the inner side of the stiffening elements 21 completely, so that this is covered with the elastic material of the inner component 52 in the region of a plugging recess 55 of which they form the radial outer limit.

Expediently, the outer component 51 is also provided with webs 53, between which are wall sections 57. The wall sections 57 cover the outside of the stiffening elements 21, thus forming an outer wall of the plug section 50, while the webs 53 of the outer component 51 and the inner component 52 connect with one another and fill out the spaces or gaps between the stiffening elements 21. It can be seen that, due to the elastic material of the outer component 51 and the inner component 52, the webs 53 are elastically yielding, so that the stiffening elements 21, which are blade-like or lamellar in form, can move towards or away from one another, at least in the region of their free longitudinal ends 23. This moveability is further facilitated in that the lateral distance 24 between the stiffening elements 21 is greater in the region of the free longitudinal ends 23 than in the region their other longitudinal end regions or foot regions 22.

Figure 4:
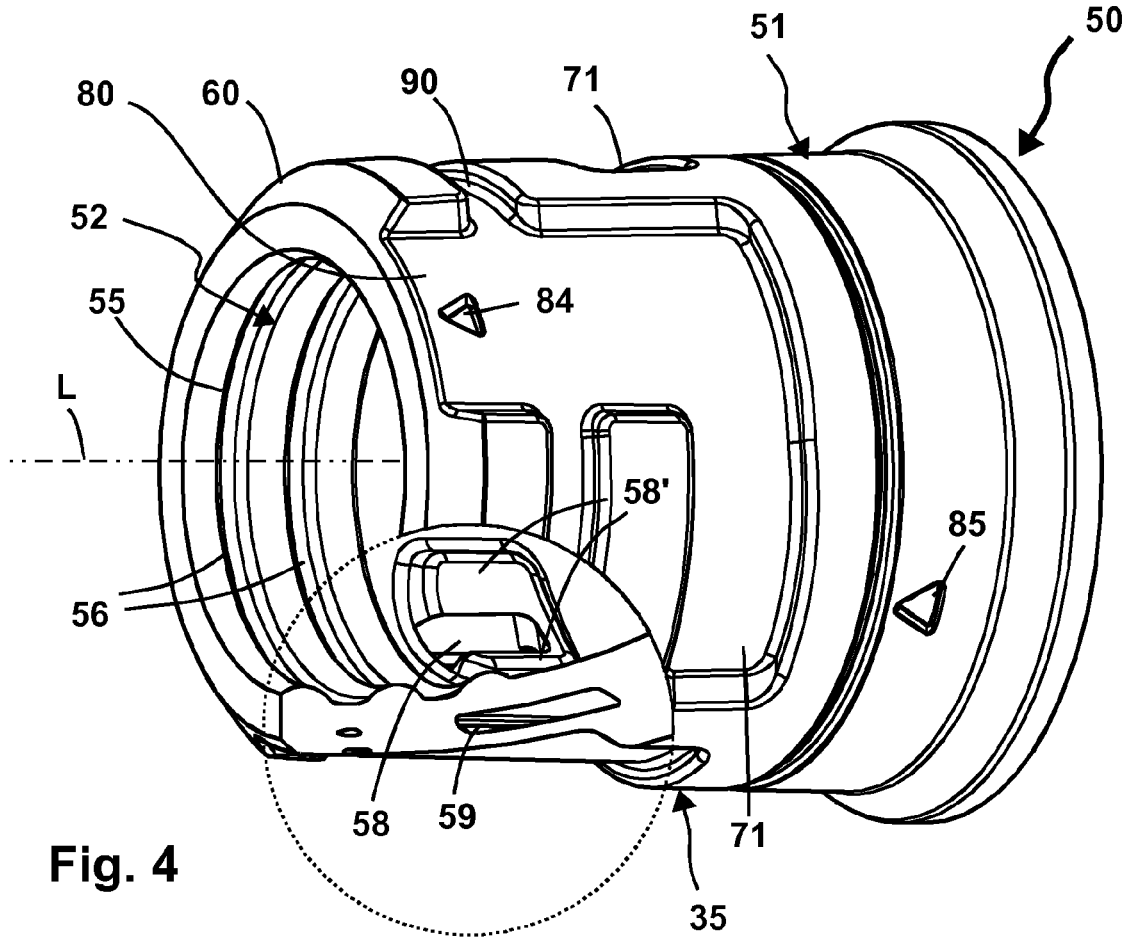
FIG. 4 shows a plug section.

FIG. 4 illustrates the complete plug section 50, i.e. in the state in which the inner component 52 is already joined with the outer component 51. As a result of the spraying process by means of which the two components 51, 52 are produced being carried out as quickly as possible, the basic material of the plug section 50 combines as far as possible homogeneously. It is also conceivable that the plug section 50 as a whole is sprayed or cast onto the stiffening structure 20 or the tubular body 11 (in one spraying or casting operation). In any case, cavities 59 for the stiffening elements 21 are provided on the plug section 50 or its main plug section body 60.

Figure 15:
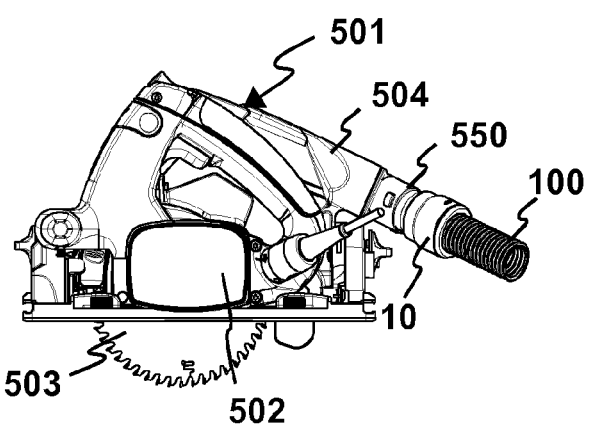
FIG. 15 shows a further hand-held machine tool in the form of a power saw to which a suction hose with a connecting piece according to the invention is connected.
Figure 15:
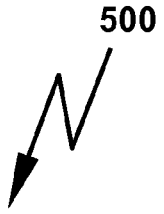
Figure 16:
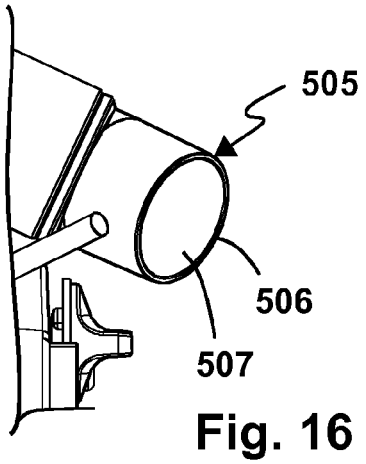
FIG. 16 shows the suction hose connection, i.e. the mating connecting piece, of the hand-held machine tool shown in FIG. 15.

In addition, there is a ribbed structure 56 located on an inner periphery of the plugging recess 55 which is expediently formed by the elastic or elastomeric material of the inner component 52 and which can ensure a firm grip and/or a good seal, for example on a relatively smooth connecting tube or mating connector 505 of the hand-held machine tool 500 shown in FIGS. 15,16. For example, the connector element 505 can be plugged into the plugging recess 55 or the connecting piece 10 can be plugged onto the mating connecting piece 505.

The ribbed structure 56 comprises one or more annular, in particular peripheral, longitudinal latch contours 61, for example grooves 62. These make possible a longitudinal snap-locking engagement with mating longitudinal latch contours 302 on a plug section 301 of the mating connecting piece 300 which can be plugged into the plugging recess 55. The mating connecting piece 300 can for example be connected with a suction hose, a hand-held machine tool or the like by means of clamping arms or retaining arms 303, between which gaps 304 are expediently present. On the retaining arms 303 there is a for example a thread or a snap-locking structure 305 for screwing or snap-locking together with a connector element, in particular of a suction hose or a hand-held machine tool or of a vacuum cleaner. This is to be understood as being purely by way of example, since it is the plug section 301 which is important here, whereas the other side 307 with for example the retaining arms 303 could perfectly well be of an alternative design. It is for example possible that the side or the section 307 forms an integral component of a hand-held machine tool, of a vacuum cleaner or the like.

The mating connecting piece 300 can for example be a component made of polypropylene or another hard plastic. However, the elastically yielding plug section 50 of the connecting piece 10 yields somewhat when plugging in the plug section 301 of the mating connecting piece 300, for example in the sense of widening, so that the ribbed structure 56 and thus the longitudinal latch contours 61 can come into engagement with the mating longitudinal latch contours 302 and hold these in a direction of pull or direction of a longitudinal axis L of the plug section 50. At the same time, an optimal frictional connection is created because, expediently, the basic material of the plug section 50 has a high friction coefficient, in any case a higher friction coefficient than the material of the tubular body 11.

Figure 8:
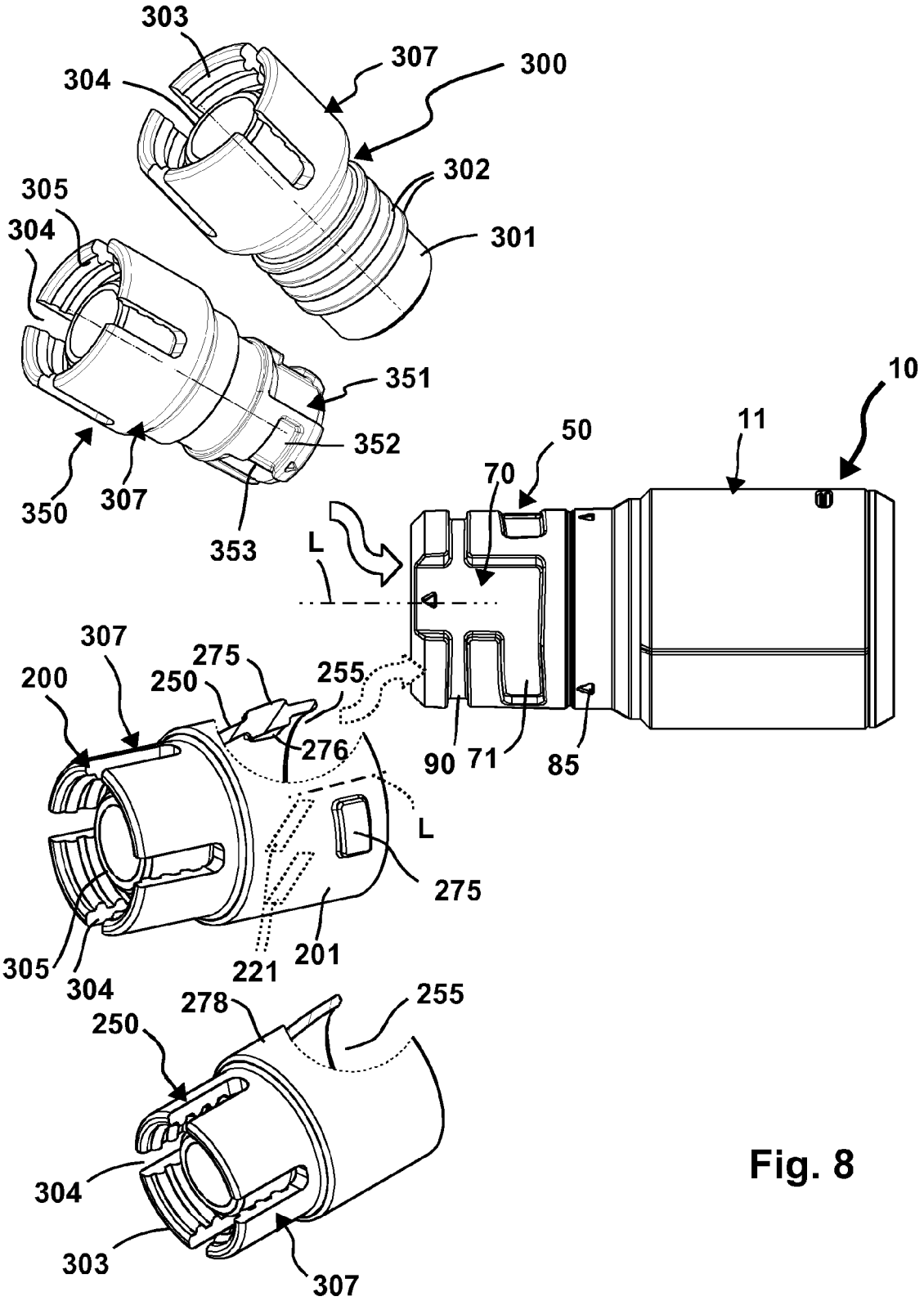
FIG. 8 shows an arrangement with the connecting piece shown in FIG. 5 in combination with several different mating connecting pieces which can be connected with and are compatible with the connecting piece.

The relatively soft, in any case yielding plug section 50 can also widen or yield to such an extent that a mating connecting piece 350 with rotational form-fit mating contours 352 on its plug section 351 can be plugged into the plugging recess 55. These rotational form-fit contours interact with rotational form-fit contours 75 of the connecting piece 10, namely with form-fit projections 26 projecting inwards into the plugging recess 55. The mating connecting piece is illustrated in FIG. 8.

It is for example conceivable that a foremost section of a connecting piece 380 corresponding approximately with the connecting piece 300 has rotational form-fit mating contours 352, as indicated in FIG. 7. The rotational form-fit mating contours 352 can be brought into engagement with the rotational form-fit contours 75 or the form-fit projections 26 of the connecting piece 10.

The form-fit projections 26 could for example be formed integrally by the basic material of the main plug section body 60, for example by the inner component 52. However, in the present case the configuration is such that the form-fit projections 26 are arranged on the stiffening elements 21 and project into the plugging recess 55 of the connecting piece 50 through openings 58 in the inner component 52. Here, they form cams which can be brought into engagement with the rotational form-fit mating contours 352 or the rotational form-fit contours 70 which will be described below. In principle, the rotational form-fit mating contours 352 correspond in geometry and form with rotational form-fit contours 70 on the outer periphery of the plug section 50 or of the connecting piece 10, which will be explained in more detail below.

Figure 3:
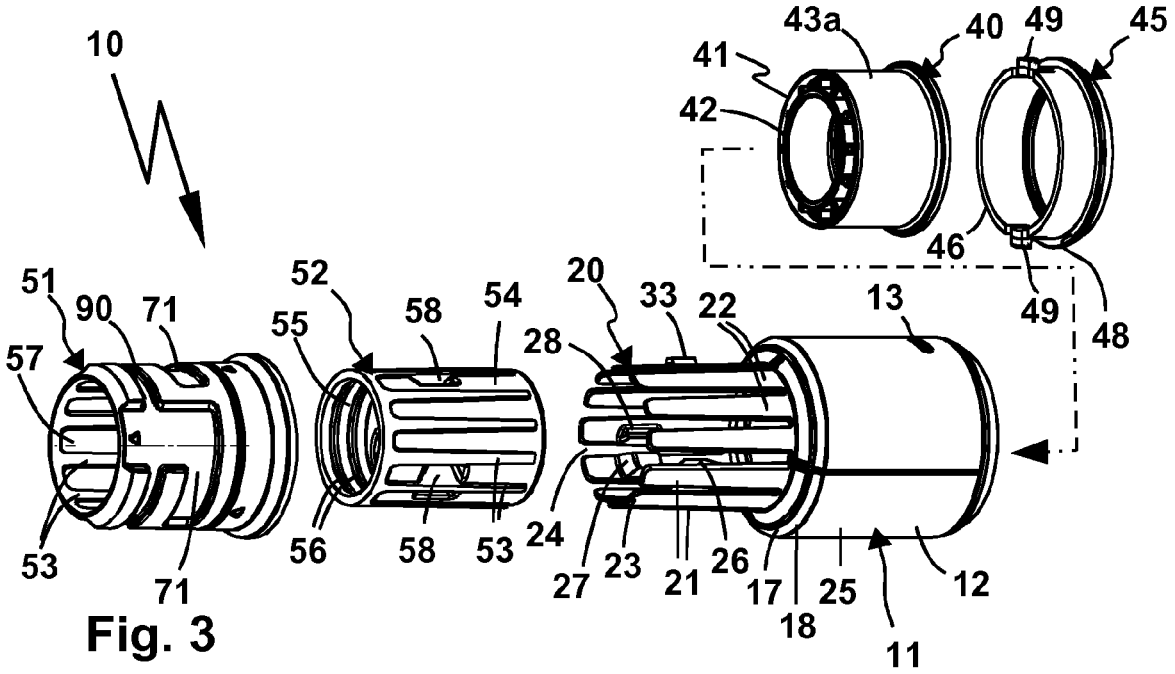

The form-fit projections 26 can for example comprise form-fit parts 27 and 28 which are arranged on adjacent stiffening elements 21. The form-fit parts 27 and 28 can, as illustrated in FIG. 3, be separate components which are however connected with one another through the inner component 52 or the outer component 51. Thus, a section with elastic plastic or the like can for example be located between the form-fit parts 27 and 28.

Figure 2:
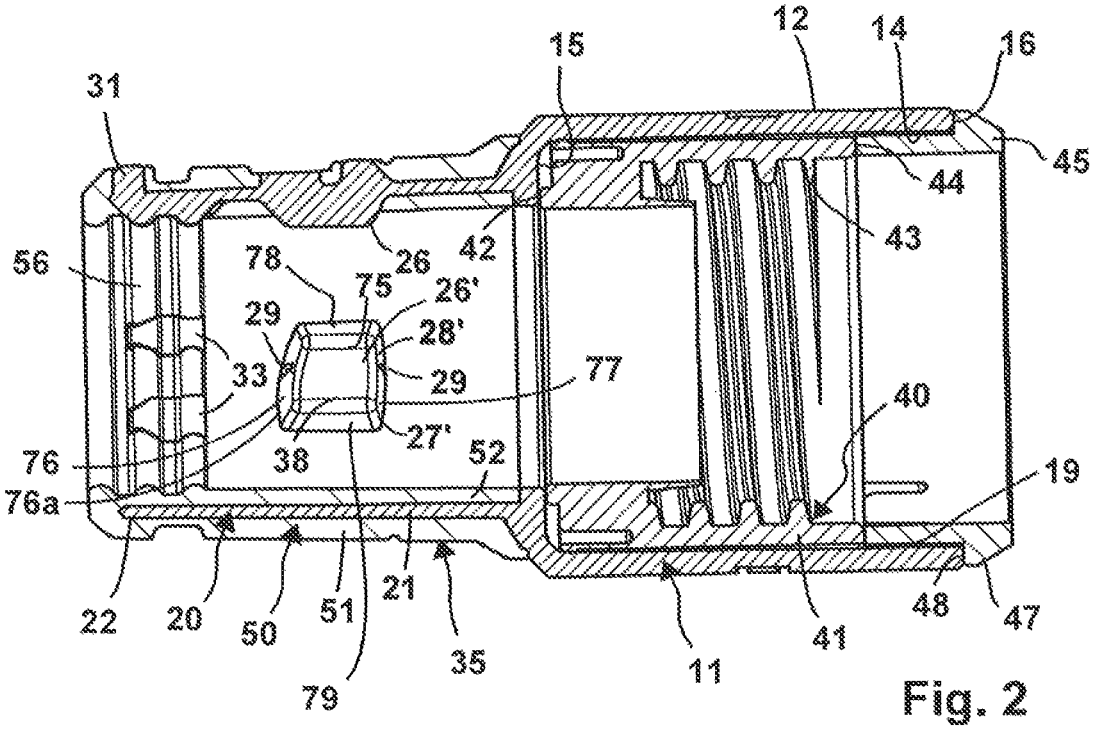
FIG. 2 shows a cross-sectional view through the connecting piece shown in FIG. 1 along a section line AA shown in FIG. 1.

A preferred exemplary embodiment is indicated in FIG. 2, in which form-fit parts 27' and 28' are connected together so to speak to form a single form-fit projection 26 with a section 26'. However, between the part sections or parts 27', 28' there is also an opening 29, so that while the part sections or parts 27', 28' bridge the circumferential gap 24 between the stiffening elements 21 on which they are arranged with the section 26', they are movable relative to one another due to the opening 29. The form-fit projection 26 according to the embodiment shown in FIG. 2 is thus formed on the basis of two form-fit parts 27' and 28' which are arranged on adjacent stiffening elements 21 which however, due to the opening 29, hinder the relative movement of the stiffening elements 21 towards or away from one another less than a so to speak solid form-fit projection 26 would. The opening 29 is expediently filled with elastic material, for example the inner component 52, but could also be free, that is to say it could only contain air, so to speak.

Also, as in the exemplary embodiment shown in FIG. 6, slot-like openings 29' can be provided in a form-fit projection 26.

The form-fit projections 26 project inwards through openings 58 from the inner component 52 into the plugging recess 55. The form-fit projections 26 are thus formed from a relatively hard material, for example polypropylene, which guarantees a high dimensional accuracy and strength.

It should be understood that the form-fit projections 26 can also be at least partially encased in the material of the main plug section body 60, as indicated in FIG. 4. For example, the form-fit projections 26 next to the opening 58 or in the region of the opening 58 in the wall section 58' for example of the inner component 52 are at least partially, or completely covered. The relatively soft material of the wall section 58' increases for example the frictional connection with associated mating form-fit contours, for example the rotational form-fit contours 70, which will be explained below.

The rotational form-fit contours 70 comprise a peripheral rotational form-fit contour 71, which is for example designed to engage with the form-fit projections 26. The form-fit projection 26 forms for example a rotational form-fit body 75.

The connecting piece 10 can be connected to and locked together in a form-fit manner with an equivalent, so to speak compatible connecting piece 10 through the plugging/rotational movement which will be described below. By way of example, the connection with a mating connecting piece 200, which is illustrated in cross section in FIG. 6, is explained in the following. The mating connecting piece 200 has for example, on a circumferential wall 201 limiting its plugging recess 255, rotational form-fit mating contours 276, for example cams, projections or the like, which project inwards into the plugging recess 255. Further rotational form-fit mating contours 275 are provided on the outer periphery of the plugging recess 255 or on the outer periphery of the circumferential wall 201, which for example fit into rotational form-fit contours of a connecting piece designed in the form of grooves.

A rotational form-fit mating contour 276 can be introduced into the peripheral rotational form-fit contour 71 through a longitudinal guide contour 80. This takes place for example if the mating connecting piece 200 is plugged onto the connecting piece 10, i.e. onto its plug section 50.

The rotational form-fit mating contour 276 is for example designed in the form of a substantially cuboid block or lug. However, the functionality of the rotational form-fit mating contour 276 is also provided by each of the form-fit projections 26, wherein the form-fit projections 26 which form the rotational form-fit contours 75 are matched even more optimally to the inner contour or form-fit contour of the peripheral rotational form-fit contour 71.

The longitudinal guide contour 80 is for example designed in the form of a slot or guide channel. The rotational form-fit contour 75 or the rotational form-fit mating contour 276 can be moved along side walls or side surfaces 81, 82 of the longitudinal guide contour in the direction of the peripheral rotational form-fit contour 71 or out of this along the longitudinal axis L. The longitudinal guide contour 80 and the peripheral rotational form-fit contour 71 are for example oriented approximately at right angles or in a hook-like form relative to one another. The gaps between the side walls 81, 82 are preferably so wide that there is still a certain amount of play between the side surfaces 78 of the rotational form-fit contour 75, namely a form-fit projection, and the side walls or side surfaces 81,82, while providing longitudinal guidance in the direction of the longitudinal axis L.

A side surface or side wall 72 and a side wall or side surface 74 of the peripheral rotational form-fit contour 71 opposite this, designed in the form of a groove or slot, preferably converge together in the direction of an end wall 73, that is to say the end region of the peripheral rotational form-fit contour 71, so that the peripheral rotational form-fit contour is somewhat narrower in the region of the end region or the end wall 73 than at its opening onto the longitudinal guide contour 80. As a result, the rotational form-fit contour 75 or rotational form-fit mating contour 276 received between the side surfaces or side walls 72, 74 is so to speak clamped tight or at least fixed in place relative to the longitudinal axis L.

During the course of a plugging movement, the rotational form-fit body 75 or the rotational form-fit mating contour 276 are thus introduced along the longitudinal axis L into the longitudinal guide contour 80, wherein a marking 84 or an index facilitates the introduction of the rotational form-fit body 75 or the rotational form-fit mating contour 276.

At the end of this plugging movement along the longitudinal axis L, the form-fit body 75 or the rotational form-fit mating contour 276 comes to rest against the longitudinal end region 83 of the longitudinal guide contour 80. The connecting piece 10 and the mating connecting piece 275 or a complementary connecting piece 10 carrying the form-fit body 75 then need to be rotated relative to one another around the longitudinal axis L, whereby the form-fit body 75 or the rotational form-fit mating contour 276 is then twisted into the groove or peripheral rotational form-fit contour 71. The rotational movement ends when the form-fit body 75 or the rotational form-fit mating contour 276 comes to rest against the longitudinal end region 83 or end wall 73 of the peripheral rotational form-fit contour 71. This rotary end position is indicated by a further marking 85.

Form-fit surfaces or side surfaces 76, 77 of the rotational form-fit contour 75, for example of the form-fit projections 26, associated with the side walls 72, 74 preferably run obliquely to one another, in correspondence with the position of the side walls 72, 74, which in addition further reinforces or improves the aforementioned wedging effect or clamping when the rotary end position or the rotary form-lock has finally been reached.

The side surface 76 and the side wall 72 are designed as sloping surfaces 76*a*, 72*a* or have sloping surfaces 76*a*, 72*a* which, on rotation of the connecting piece 10 relative to a mating connecting piece, for example a mating connecting piece 10 of similar design (see FIG. 2) or the mating connecting piece 200, i.e. if the two components are rotated around the longitudinal axis L relative to one another, result in an axial adjustment or displacement of the two components towards one another along the longitudinal axis L. The user thus only needs to rotate the connecting piece 10 and/or the mating connecting piece in order to displace the two components relative to one another along the longitudinal axis L, in particular to clamp them together. It should be understood that one of the sloping surfaces 76*a* or 72*a* is sufficient for such a displacing effect or clamping effect.

A latch contour 86, for example a rib 87, is also provided between the longitudinal guide contour 80 and the peripheral rotational form-fit contour 71. If the rotational form-fit mating contour 276 or the rotational form-fit contour 75 is to be moved out of the longitudinal guide contour 80 into the peripheral rotational form-fit contour 71 or out of this in the direction of the longitudinal guide contour 80 it must so to speak be moved past the latch contour 86. A snap-locking engagement thus takes place in a rotary direction or peripheral direction around the longitudinal axis L which secures the rotational form-fit connection.

The rib 87 is preferably made of the softer or more elastic material of the main plug section body 60, so that it is elastically yielding and thus allows the rotational form-fit contour 75 or the rotational form-fit mating contour 276 to be moved past it.

Figure 1:
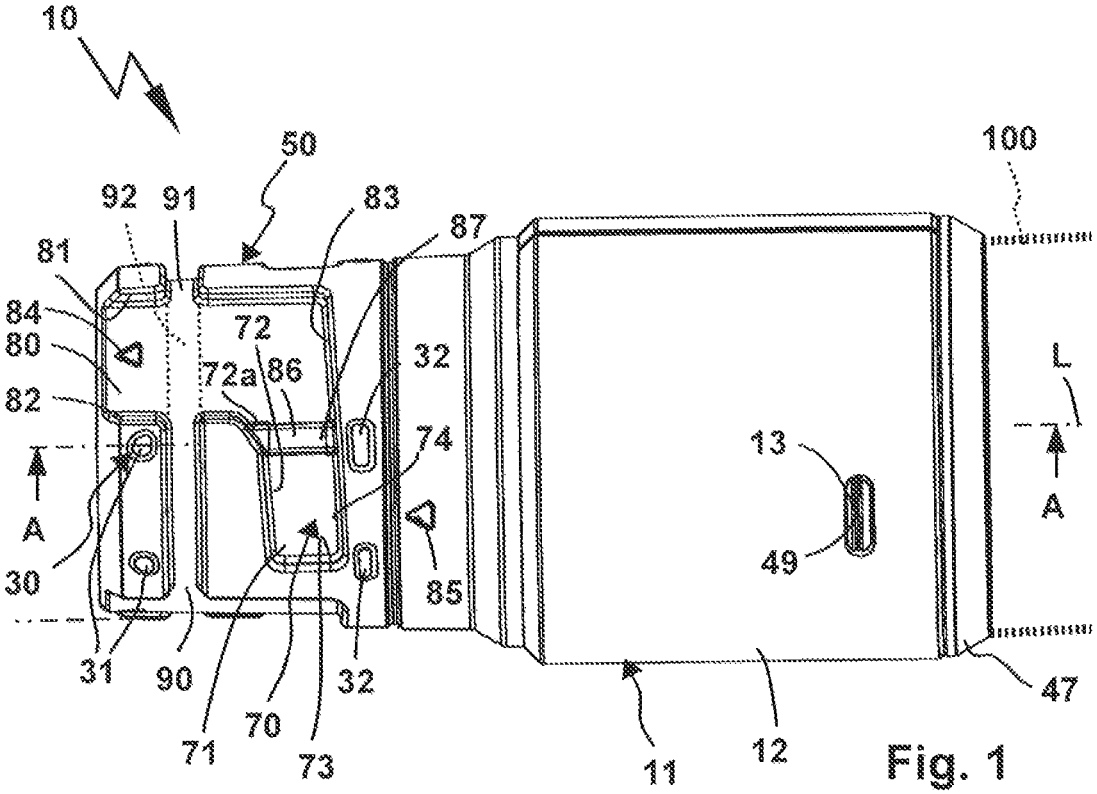
FIG. 1 shows a side view of a connecting piece with a partially represented suction hose.

In addition to the longitudinal latch contours 61 in the plugging recess 55 described above, longitudinal latch contours are also provided on the outer periphery of the plug section 50, namely longitudinal latch contours 90. The longitudinal latch contours 90 comprise for example a peripheral groove 91 which so to speak intersects with the longitudinal guide contours 80. A so to speak imaginary course 92 of the peripheral groove 91 is indicated in FIG. 1. The peripheral groove 91 thus communicates with the longitudinal guide contours 80 (3 longitudinal guide contours 80 are provided at an angular distance, preferably an identical angular distance, from one another), through this is not an essential feature. In any case, longitudinal latch contours 90 provided in or on the radially outer periphery of the plug section 50 can be snapped into a mating latch contour, for example in the manner of a ribbed structure, of an annular snap-locking projection projecting radially on the inside into a plugging recess of a mating connecting piece, of a hook or the like, in order to connect the connecting piece 10 with the mating connecting piece—not shown—so to speak in the direction of pull or longitudinal direction.

Figure 5:
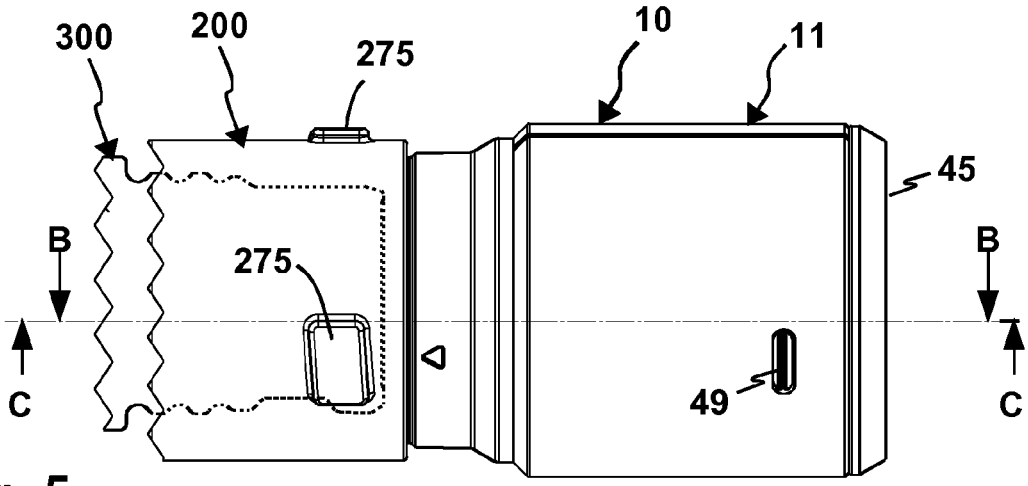
FIG. 5 shows a side view of a variant of the connecting piece shown in FIG. 2, onto which, in the illustration according to FIG. 6 a mating connecting piece is plugged (cross-sectional view along a section line BB shown in FIG. 5) and into which, in the illustration according to FIG. 7 a mating connecting piece is plugged (cross-sectional view along a section line CC shown in FIG. 5)

In the exemplary embodiment shown in FIGS. 5, 6 and 7 it is expediently the case that the plug section 50, in particular the outer component 51, is electrically conductive. This allows static electricity to be dissipated, for example.

However, a relatively hard plastic is particularly suitable in terms of being electrically conductive. In this case, through the multiple-component design of the connecting piece 10 in the embodiment shown in FIGS. 1 and 2, the necessary electrical conductivity can nonetheless be provided in a particularly convenient manner if corresponding openings are provided in the more elastic component or soft component which are passed through by parts of the harder component, which is electrically conductive. For example, an electrical contact arrangement 30 with electrical contact sections 31, 32 is provided which projects radially outwards from the outer component 51. The rib 87 or latch contour 86 and/or at least one of the form-fit projections 26 can be designed as an electrically conductive component. Preferably, further electrical contact surfaces 33 are provided, for example in the region of the ribbed structure 56, so that on the one hand the form-fit projections 26, and on the other hand these further contact surfaces 33 are available in order to create an electrical connection, in any case inside the plugging recess 55.

At this point it should be noted that the latch contour 86 or rib 87 can also be formed by one relatively hard component of the connecting piece 10, for example in the form of a projection on one of the stiffening elements 75 which projects from the outer component 51.

Preferably, in a connecting piece according to the invention, several peripheral rotational form-fit contours and possibly several longitudinal guide contours communicating with these are provided. For example, in the connecting piece 10 three such configurations are provided spaced at equal angular intervals 3. For the same reason, 3 form-fit projections 26 or rotational form-fit contour 75 are also provided, arranged at the same angular intervals.

While the rotational form-fit contours 70 so to speak form outer rotational form-fit contours, the rotational form-fit contours 75 are so to speak inner rotational form-fit contours. Naturally, it is possible that, as for example in the mating connecting piece 200, which one can also regard as a connecting piece in the sense of the invention, rotational form-fit contours of the same type, namely the cam-like rotational form-fit mating contours 275, 276 are provided both on the inside and on the outside in the region of the plugging recess 255. Here too, 3 inner rotational form-fit mating contours 276 arranged at the same angular distance from one another are provided, as well as outer rotational form-fit mating contours 275.

In contrast, the mating connecting piece 52 has a circumferential wall 278 which defines the limits of a plugging recess 255 but does not have any rotational form-fit contours or rotational form-fit mating contours. This is also typically the case with known hand-held machine tools, for example in the variant illustrated in FIG. 16. However, the plug section 50 can also be plugged into the plugging recess 255 of the mating connecting piece 250 and can thereby be compressed, so that it adapts optimally to the inner contour of the plugging recess 255.

In the exemplary embodiments described so far, the connecting piece according to the invention is represented as a component arranged for example on the suction hose 100. However, it can also be a component of a vacuum cleaner or a hand-held machine tool, as will be made clear in the following.

Figure 9:
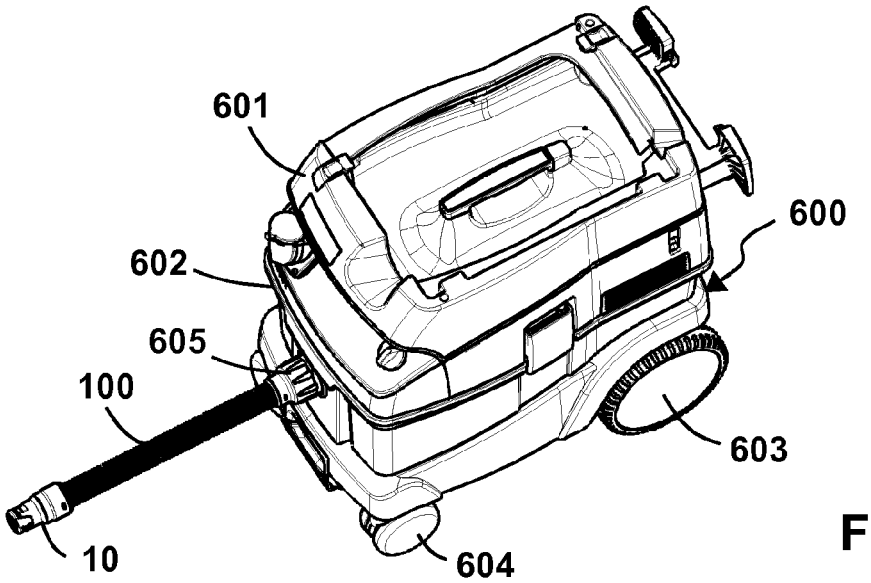
FIG. 9 shows a vacuum cleaner with a suction hose, on the free end of which a connecting piece, corresponding for example to the connecting piece shown in FIG. 5, is arranged.
Figure 10:
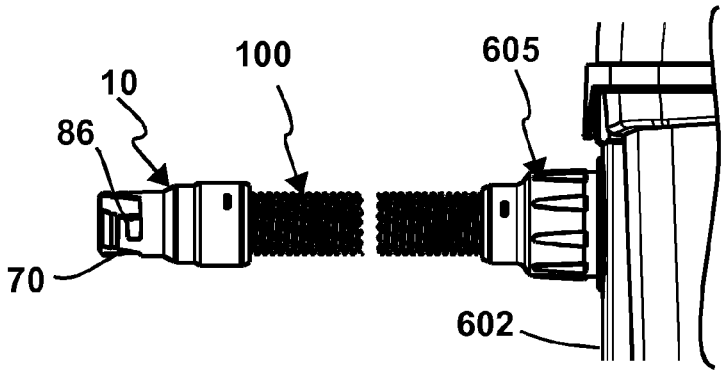
FIG. 10 shows an enlarged detail view of FIG. 9 from the side.
Figure 11:
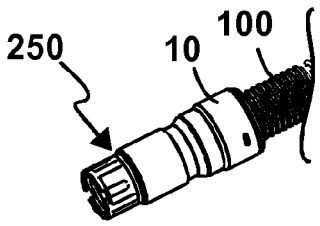
FIG. 11 shows a front end of the suction hose of the vacuum cleaner shown in FIGS. 9, 10, wherein a mating connecting piece is plugged onto the connecting piece.

For example, a connecting piece according to the invention 10 is located at the free end of a suction hose 100 of a vacuum cleaner 600 shown in FIG. 9. The suction hose connection 605 of the vacuum cleaner 600, which is for example arranged on the front side 602 of its housing 601, can be of conventional design. For example, the suction hose 100 is plugged onto the suction hose connection 605. The other connection of the suction hose 100, intended for example for connecting with the hand-held machine tool 700 or 500, is provided with the connecting piece 10 (FIG. 10), whereby the rotational form-fit contours 70 provided therein as well as the latch contour 86 guarantee an optimally secure connection to the connected hand-held machine tool.

Naturally, only the mating connecting piece 52, for example, can be plugged onto the connecting piece 10.

Figure 12:
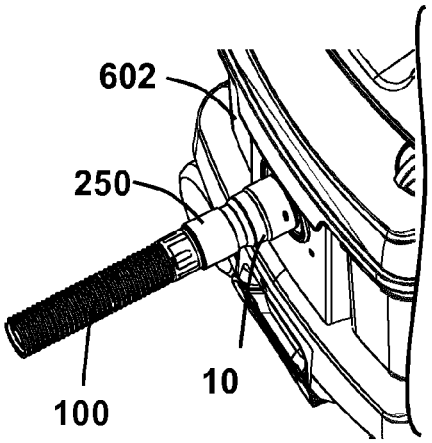
FIG. 12 shows a variant of the vacuum cleaner shown in FIG. 9, wherein this is equipped with a connecting piece according to the invention, for example in the design shown in FIG. 5.

However, it is also possible that the connecting piece according to the invention 10 is for example provided on the vacuum cleaner 600 instead of the suction hose connection 605 with for example only one bushing or one sleeve (FIG. 12). In this case, this can for example be provided for the connection of a mating connecting piece 200 or of a connecting piece 10 of the same type, in order to make possible a more secure gripping of the suction hose 100. However, in the exemplary embodiment shown in FIG. 12, a suction hose 100 with a mating connecting piece 250 is connected to the connecting piece 10 of the vacuum cleaner 10.

Figure 13:
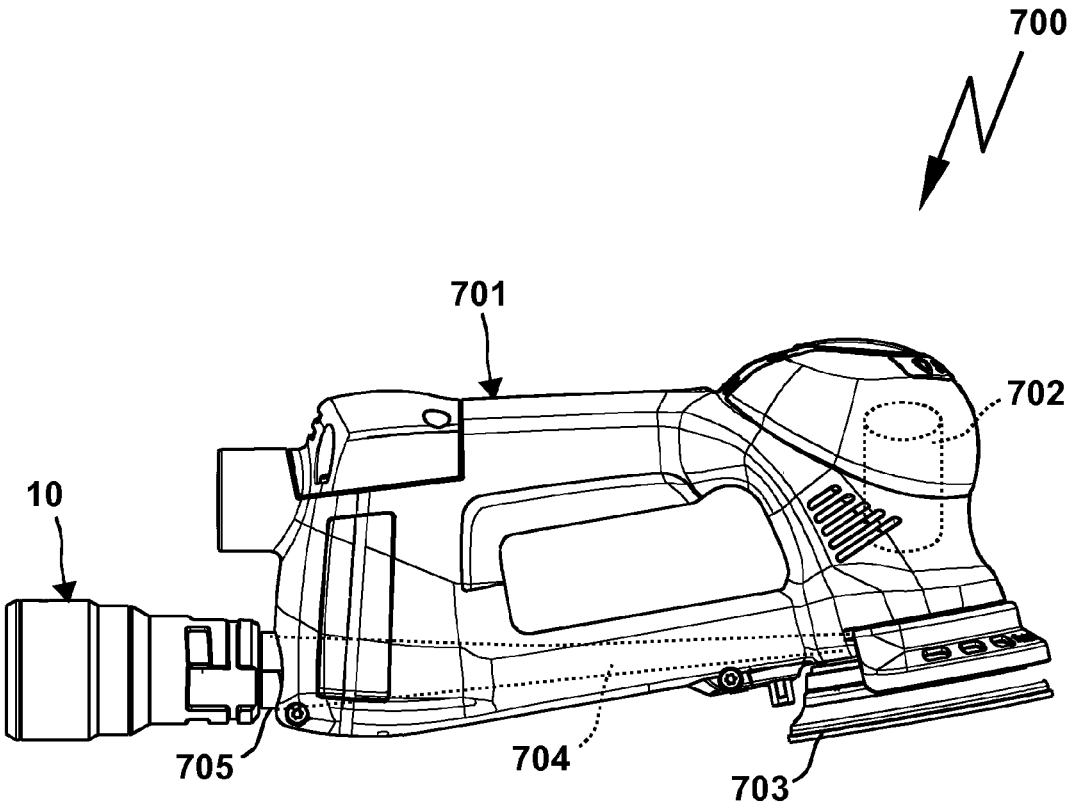
FIG. 13 shows a side view of a hand-held machine tool in the form of a grinder, the suction hose connection of which forms a mating connecting piece onto which a connecting piece according to, for example.
Figure 14:
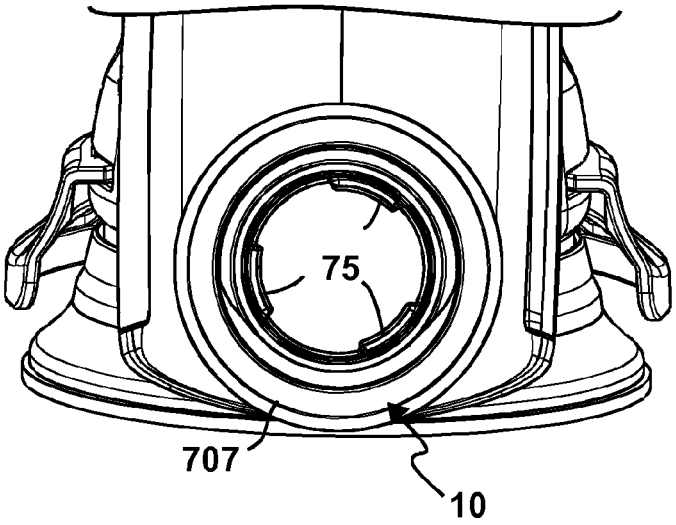
FIG. 14 shows a rear view of a variant of the hand-held machine tool shown in FIG. 13, wherein this is, alternatively, equipped with a connecting piece according to the invention, e.g. the connecting piece shown in FIG. 19 or FIG. 5 or 8.

A hand-held machine tool 700, for example a grinder, has a drive motor 702 for driving a grinding tool 703. During operation of the hand-held machine tool 700, dust is produced which is passed through a dust guidance channel 704, which runs through the housing 701, in the direction of a dust outlet 705. A connecting piece according to the invention 10 can be connected to this, for example to the dust outlet 705, which for example has a ribbed structure like for example the mating connecting piece 380 (FIG. 13). Alternatively, however, it is also possible, as illustrated in FIG. 14, that for example a connecting piece 707 with rotational form-fit contours 75 is provided. The rotational form-fit contours 75 can for example be brought into engagement with the rotational form-fit contours 70 of a connecting piece according to the invention 10.

In the hand-held machine tool 500 shown in FIGS. 15-19, a conventional connecting tube can for example be provided as the mating connecting piece 505, as illustrated in FIG. 16. Its circumferential wall 506 delimits for example a plugging recess 507, into which the connecting section 50 of a connecting piece according to the invention 10 can be plugged, see for example FIG. 19. For example, a motor 502 arranged in the housing 501 of the hand-held machine tool 500 drives a tool 503, for example a saw blade.

Figure 17:
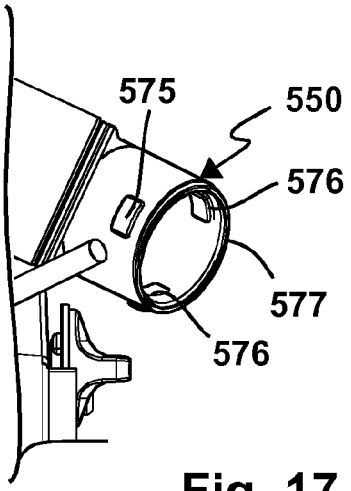
FIG. 17 shows a first variant according to the invention of the suction hose connection of the hand-held machine tool, wherein this comprises a first connecting piece according to the invention.

Alternatively, as illustrated in the FIGS. 15 and 17, a mating connecting piece 550 can be arranged on the end of a dust guidance channel 504 of the hand-held machine tool 500. For example, dust, chips or the like produced during operation of the hand-held machine tool 500 flow through the dust guidance channel 504. On the mating connecting piece 550, rotational form-fit mating contours 576 are arranged radially on the inside and rotational form-fit contours 575 are arranged radially on the outside of a circumferential wall 577 which forms the limits of a plugging recess. Thus, both when plugging on and when plugging in a connecting piece according to the invention, for example the connecting piece 10, rotational form-fit mating contours are provided which guarantee a particularly secure hold resistant to tensile forces relative to the longitudinal axis L.

At this point it should be mentioned that the mating connecting piece 550 can consist exclusively of relatively hard plastic and represent a connecting piece in the sense of the invention, since it has rotational form-fit contours or rotational form-fit mating contours arranged both radially on the inside and radially on the outside of its plug section.

Figure 18:
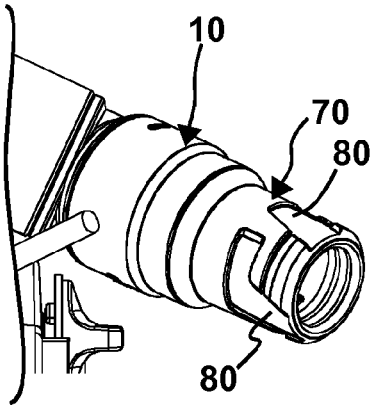
FIG. 18 shows a second variant according to the invention of the suction hose connection of the hand-held machine tool with a second connecting piece, corresponding for example to the connecting piece shown in FIG. 5 or 8.
Figure 19:
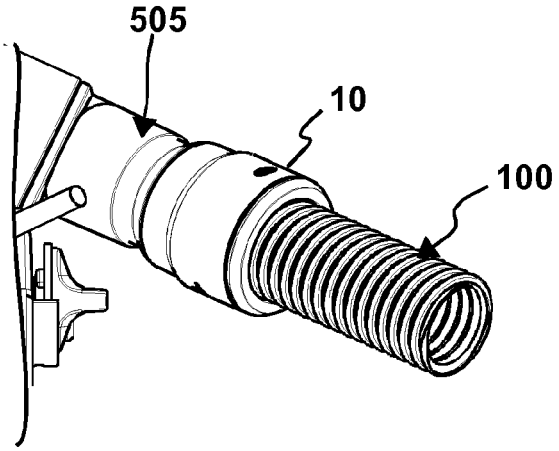
FIG. 19 shows the arrangement shown in FIG. 18 with connected suction hose.

In the exemplary embodiment shown in FIG. 18, a connecting piece 10 is arranged, for example permanently or detachably, on the dust outlet of the hand-held machine tool 500. This preferably consists of a hard component and a soft component, as explained, and/or has on its plug section both the longitudinal guide contour 80 and also the rotational form-fit contour 70, so that a particularly secure hold of the mating connecting piece 200 for example is possible.

The circumferential wall 201 can consist of a relatively hard plastic, for example polypropylene. In contrast, the plug section 50 designed to be plugged into the plugging recess 255 inside the circumferential wall 201 consists, at least on its outer periphery, of a comparatively softer plastic, as a result of which a particularly secure, friction-locking hold and in addition also a good seal can be achieved. However, it is also quite possible that the circumferential wall 201 also consists of soft plastic, in particular of the same plastic material as the plug section 50. It is also conceivable that the circumferential wall 201 is stiffened by means of stiffening elements in the manner of the stiffening elements 21. For example, strip-formed stiffening elements 221 are provided. The stiffening elements 221 are inclined obliquely relative to the longitudinal axis L, i.e. unlike the stiffening elements 21 they are not oriented parallel to the longitudinal axis L. Both in the variant with a hard circumferential wall 201, i.e. a hard plug section 250, and also with a plug section 250 which is soft or stiffened with stiffening elements 221 or 21, the mating connecting piece 200 in each case represents an optimisation in comparison with known connecting pieces or mating connecting pieces. The mating connecting piece 200 can for example form a component of the hand-held machine tool 500 or 700 or also of the vacuum cleaner 600, for example in each case as a connection for the suction hose.

The invention claimed is:

1. A suction hose connecting piece for a suction hose designed to create a flow connection from a machine tool to a vacuum cleaner, said connecting piece comprising:

a tubular body with a circumferential wall which delimits a flow channel; and a plug section arranged on said tubular body designed to create a plug connection with a mating connecting piece, wherein the connecting piece and the mating connecting piece can be plugged together along a longitudinal axis of the plug section, the plug section comprising:

an inner circumferential surface;

an outer circumferential surface;

a longitudinal latch contour formed on the inner circumferential surface of the plug section, the longitudinal latch contour being adapted to counteract detachment of the mating connecting piece from the connecting piece relative to the longitudinal axis and being further adapted to engage with a mating longitudinal latch contour of the mating connecting piece when the mating connecting piece is plugged onto the connecting piece along the longitudinal axis of the plug section; and at least one rotational form-fit contour formed on the same inner circumferential surface and the same piece of the plug section as the longitudinal latch contour, the at least one rotational form-fit contour being adapted to create a form-fit connection with a rotational form-fit mating contour of the mating connecting piece, wherein the at least one rotational form-fit contour can be brought into or out of engagement with a mating rotational form-fit mating contour of the mating connecting piece through a relative rotational movement of the connecting piece and the mating connecting piece, wherein at least one of the rotational form-fit contour or at least one latch contour comprises a harder material than the main plug section body of the plug section carrying the rotational form-fit contour or latch contour.

2. The suction hose connecting piece according to claim 1, wherein the longitudinal latch contour comprises an annular peripheral groove or an annular peripheral projection.

3. The suction hose connecting piece according to claim 1, wherein the longitudinal latch contour forms a component of an arrangement of at least two longitudinal latch contours, which are arranged next to one another or behind one another relative to the longitudinal axis.

4. The suction hose connecting piece according to claim 1, wherein the at least one rotational form-fit contour is arranged, in a plugging direction, behind or in front of the longitudinal latch contour, so that on being plugged onto the connecting piece the mating connecting piece first comes into contact with the longitudinal latch contour and then with the rotational form-fit contour, or vice versa.

5. The suction hose connecting piece according to claim 1, wherein the at least one rotational form-fit contour comprises at least one peripheral rotational form-fit contour running helically or at a right angle, relative to the longitudinal axis of the plug section in the form of a peripheral groove, or a thread or a bayonet-type rotational form-fit contour or at least one form-fit cam, designed to screw into a rotational form-fit mating contour running in a peripheral direction around the longitudinal axis of the plug section.

6. The suction hose connecting piece according to claim 1, wherein the at least one rotational form-fit contour comprises at least one inner rotational form-fit contour arranged on an inner periphery of the plug section to accommodate a mating outer rotational form-fit contour arranged on an outer periphery of the mating plug-in connecting piece and at least one outer rotational form-fit contour arranged on an outer periphery of the plug section to accommodate a mating inner rotational form-fit contour arranged on an inner periphery of the plug-on mating connecting piece.

7. The suction hose connecting piece according to claim 1, further comprising at least one latch contour, which can be brought into snap-locking engagement or out of snap-locking engagement with a mating latch contour of the mating connecting piece through the relative rotational movement of the connecting piece and the mating connecting piece around the longitudinal axis of the plug section or a longitudinal movement or sliding movement parallel to the longitudinal axis of the plug section.

8. The suction hose connecting piece according to claim 7, wherein, in order to achieve a spring effect, the at least one latch contour consists of an elastic material or is arranged on an elastic section of the connecting piece or the at least one latch contour comprises a snap-locking recess running transversely to the relative rotational movement or a snap-locking projection running transversely to the relative rotational movement.

9. The suction hose connecting piece according to claim 7, wherein the at least one rotational form-fit contour or the at least one latch contour is provided on a form-fit body which comprises a recess, which is suitable for deformation of the form-fit body, so that the form-fit body yields on being brought into engagement with the associated rotational form-fit mating contour or mating latch contour, or brought out of engagement with the mating contour.

10. The suction hose connecting piece according to claim 7, wherein the rotational form-fit contours or the at least one latch contour associated therewith can, through the elastic deformation, be brought into snap-locking engagement or out of a snap-locking engagement with the rotational form-fit mating contours or a mating latch contour.

11. The suction hose connecting piece according to claim 1, wherein at least one of the rotational form-fit contours or at least one latch contour is elastically yielding or arranged on an elastically yielding main plug section body or basic material of the plug section.

12. The suction hose connecting piece according to claim 1, further comprising at least one form-fit body for forming a form-fit contour the basic material of which is covered, at least in sections in the region of the rotational form-fit contour, with a softer or more elastic material or one with a higher friction coefficient relative to the basic material.

13. The suction hose connecting piece according to claim 1, further comprising a mounting for a suction hose arranged in a fixed manner on the tubular body or mounted on the tubular body so as to be resistant to displacement relative to the longitudinal axis or rotatable, or it forms a component of a suction hose or of a vacuum cleaner or a hand-held machine tool or it forms an adapter for connecting two tubular components for connecting two suction hoses, or wherein it forms a system comprising the connecting piece and the mating connecting piece.

14. The suction hose connecting piece according to claim 1, wherein a longitudinal latch contour is arranged on the plug section, which counteracts detachment of the mating connecting piece from the connecting piece relative to the longitudinal axis which engages with a mating longitudinal latch contour of the mating connecting piece when the mating connecting piece is plugged onto the connecting piece along the longitudinal axis of the plug section.

15. A device with a suction hose connecting piece according to claim 1, wherein the device is a suction hose or a machine tool or a hand-held machine tool or a vacuum cleaner.

16. The suction hose connecting piece according to claim 1, wherein the plug section further comprises an annular peripheral groove or an annular peripheral projection formed on the outer circumferential surface of the plug section.

17. The suction hose connecting piece according to claim 1, wherein the plug section further comprises a substantially cuboid form-fit projection formed on the outer circumferential surface of the plug section.

18. A suction hose connecting piece for a suction hose designed to create a flow connection from a machine tool to a vacuum cleaner, said connecting piece comprising:

a tubular body with a circumferential wall which delimits a flow channel; and a plug section arranged on said tubular body designed to create a plug connection with a mating connecting piece, wherein the connecting piece and the mating connecting piece can be plugged together along a longitudinal axis of the plug section, the plug section comprising:

an inner circumferential surface;

an outer circumferential surface;

a longitudinal latch contour formed on the inner circumferential surface of the plug section, the longitudinal latch contour being adapted to counteract detachment of the mating connecting piece from the connecting piece relative to the longitudinal axis and being further adapted to engage with a mating longitudinal latch contour of the mating connecting piece when the mating connecting piece is plugged onto the connecting piece along the longitudinal axis of the plug section; and at least one rotational form-fit contour formed on the inner circumferential surface of the plug section, the at least one rotational form-fit contour being adapted to create a form-fit connection with a rotational form-fit mating contour of the mating connecting piece, wherein the at least one rotational form-fit contour can be brought into or out of engagement with a mating rotational form-fit mating contour of the mating connecting piece through a relative rotational movement of the connecting piece and the mating connecting piece, wherein the plug section comprises a softer or more yielding material than the tubular body supporting the plug section.

19. The suction hose connecting piece according to claim 18, wherein the material of the plug section has a hardness of 40/100 Shore A, and the material of the tubular body has a hardness of 30/100 Shore D, or wherein the material of the tubular body has a modulus of elasticity of 800/2500 $N/mm^2$, and the material of the plug section has a modulus of elasticity of at most 800 $N/mm^2$, or wherein the material of the plug section has an elongation at break of >70% and the material of the tubular body has an elongation at break of >30%, or wherein the material of the plug section comprises or is a thermoplastic elastomer or wherein the material of the tubular body comprises or is polypropylene or polyamide comprises or the material of the tubular body is at least 1.5 times as stiff as the material of the plug section.

20. A suction hose connecting piece for a suction hose designed to create a flow connection from a machine tool to a vacuum cleaner, said connecting piece comprising:

a tubular body with a circumferential wall which delimits a flow channel; and a plug section arranged on said tubular body designed to create a plug connection with a mating connecting piece, wherein the connecting piece and the mating connecting piece can be plugged together along a longitudinal axis of the plug section, the plug section comprising:

an inner circumferential surface;

an outer circumferential surface;

a longitudinal latch contour formed on the inner circumferential surface of the plug section, the longitudinal latch contour being adapted to counteract detachment of the mating connecting piece from the connecting piece relative to the longitudinal axis and being further adapted to engage with a mating longitudinal latch contour of the mating connecting piece when the mating connecting piece is plugged onto the connecting piece along the longitudinal axis of the plug section; and at least one rotational form-fit contour formed on the same inner circumferential surface and the same piece of the plug section as the longitudinal latch contour, the at least one rotational form-fit contour being adapted to create a form-fit connection with a rotational form-fit mating contour of the mating connecting piece, wherein the at least one rotational form-fit contour can be brought into or out of engagement with a mating rotational form-fit mating contour of the mating connecting piece through a relative rotational movement of the connecting piece and the mating connecting piece, wherein one of the tubular body and the plug section comprises a first material and the other of the tubular body and the plug section comprises a second material, the first material being less electrically conductive than the second material, wherein the second material, at least in sections, projects before the first material in order to create an electrical connection with the mating connecting piece or is arranged before the first material.

21. A suction hose connecting piece for a suction hose designed to create a flow connection from a machine tool to a vacuum cleaner, said connecting piece comprising:

a tubular body with a circumferential wall which delimits a flow channel; and a plug section arranged on said tubular body designed to create a plug connection with a mating connecting piece, wherein the connecting piece and the mating connecting piece can be plugged together along a longitudinal axis of the plug section, the plug section comprising:

an inner circumferential surface;

an outer circumferential surface;

a longitudinal latch contour formed on the inner circumferential surface of the plug section, the longitudinal latch contour being adapted to counteract detachment of the mating connecting piece from the connecting piece relative to the longitudinal axis and being further adapted to engage with a mating longitudinal latch contour of the mating connecting piece when the mating connecting piece is plugged onto the connecting piece along the longitudinal axis of the plug section; and at least one rotational form-fit contour formed on the same inner circumferential surface and the same piece of the plug section as the longitudinal latch contour, the at least one rotational form-fit contour being adapted to create a form-fit connection with a rotational form-fit mating contour of the mating connecting piece, wherein the at least one rotational form-fit contour can be brought into or out of engagement with a mating rotational form-fit mating contour of the mating connecting piece through a relative rotational movement of the connecting piece and the mating connecting piece, wherein the connecting piece has a tubular section, structured as a multiple-component section, with a longitudinal axis forming or comprising the plug section, wherein, as a second component, at least one elongated stiffening element made of a stiffening material which is harder or which exhibits higher tensile strength or flexural strength or greater stiffness in comparison with the basic material is embedded in a basic material of the tubular section forming a first component.

* * * * *